US011676783B2

(12) United States Patent
Yoshihara et al.

(10) Patent No.: US 11,676,783 B2
(45) Date of Patent: Jun. 13, 2023

(54) PRESS-TYPE INPUT DEVICE AND PRESS-ROTATE-TYPE INPUT DEVICE

(71) Applicant: Panasonic Intellectual Property Management Co., Ltd., Osaka (JP)

(72) Inventors: Satoshi Yoshihara, Hyogo (JP); Mitsuru Satou, Osaka (JP); Masaki Sawada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 15 days.

(21) Appl. No.: 17/284,422

(22) PCT Filed: Aug. 6, 2019

(86) PCT No.: PCT/JP2019/030816
§ 371 (c)(1),
(2) Date: Apr. 9, 2021

(87) PCT Pub. No.: WO2020/075377
PCT Pub. Date: Apr. 16, 2020

(65) Prior Publication Data

US 2021/0350987 A1 Nov. 11, 2021

(30) Foreign Application Priority Data

Oct. 9, 2018 (JP) ..... JP2018-191083

(51) Int. Cl.
*H01H 25/06* (2006.01)
*G05G 1/02* (2006.01)
(Continued)

(52) U.S. Cl.
CPC ..... *H01H 25/06* (2013.01); *G05G 1/02* (2013.01); *H01H 13/04* (2013.01); *H01H 13/14* (2013.01)

(58) Field of Classification Search
CPC ..... H01H 25/06; H01H 13/04; H01H 13/14; H01H 2237/004; H01H 13/20;
(Continued)

(56) References Cited

U.S. PATENT DOCUMENTS 8,941,585 B2 * 1/2015 Minamitani ..... G05G 1/08 345/184
10,020,137 B2 * 7/2018 Shitanaka ..... H01H 13/20
(Continued)

FOREIGN PATENT DOCUMENTS

EP 1981049 A1 10/2008
EP 1995753 A1 11/2008
(Continued)

OTHER PUBLICATIONS

International Search Report issued in corresponding International Patent Application No. PCT/JP2019/030816, dated Oct. 21, 2019, w/Engiish translation.
(Continued)

*Primary Examiner* — Lheiren Mae A Caroc
(74) *Attorney, Agent, or Firm* — McDermott Will & Emery LLP

(57) ABSTRACT

A press-type input device includes a first pressing member, a second pressing member, a base, and a holding member. The first pressing member has a pressure receiving surface and a first axis and is tiltable around the first axis. The second pressing member has a second axis and is tiltable around the second axis. The base includes a detection unit configured to detect a tilt of the second pressing member. The holding member is configured to hold, together with the base, the first pressing member and the second pressing member. A location of at least one of the first axis or the second axis is variable in accordance with a pushed location on the pressure receiving surface. When viewed in a direc-
(Continued)

tion vertical to the pressure receiving surface, the second axis and the detection unit do not overlap each other.

16 Claims, 29 Drawing Sheets

(51) Int. Cl.
*H01H 13/04* (2006.01)
*H01H 13/14* (2006.01)

(58) Field of Classification Search
CPC .. H01H 21/36; H01H 25/065; H01H 2217/01; G05G 1/02
See application file for complete search history.

(56) References Cited

U.S. PATENT DOCUMENTS

2004/0026220 A1 2/2004 Inoue et al.
2006/0230838 A1 10/2006 Miyasaka et al.
2020/0051764 A1* 2/2020 Hwang ..... H01H 25/06

FOREIGN PATENT DOCUMENTS

JP H0561934 U 8/1993
JP H09-245580 A 9/1997
JP 2004-13507 A 1/2004
JP 2006-286458 A 10/2006
JP 4934550 B2 5/2012

OTHER PUBLICATIONS

Extended European Search Report dated Nov. 4, 2021 issued in corresponding European Patent Application No. 19871203.6.

* cited by examiner

PRESS-TYPE INPUT DEVICE AND PRESS-ROTATE-TYPE INPUT DEVICE

CROSS-REFERENCE OF RELATED APPLICATIONS

This application is the U.S. National Phase under 35 U.S.C. § 371 of International Patent Application No. PCT/JP2019/030816, filed on Aug. 6, 2019, which in turn claims the benefit of Japanese Application No. 2018-191083, filed on Oct. 9, 2018, the entire disclosures of which Applications are incorporated by reference herein.

TECHNICAL FIELD

The present disclosure generally relates to press-type input devices and press-rotate-type input devices, and specifically, to a press-type input device including pressing members and a press-rotate-type input device including a rotor.

BACKGROUND ART

Patent Literature 1 discloses a rotation-type electric component. The rotation-type electric component disclosed in Patent Literature 1 includes a housing, an operation shaft which is hollow, a rotation detector, and a push switch. The housing includes a bearing section which is hollow. The operation shaft is rotatably held by the bearing section. The rotation detector is accommodated in the housing and detects the rotation of the operation shaft. The push switch is accommodated in the housing and is driven along with a push operation in the axis direction of the operation shaft. The operation shaft is rotatably held by the outer periphery of the bearing section. An accommodation section is provided on an outer peripheral side of the bearing section of the housing to have an annular shape. The rotation detector and the push switch are disposed in the accommodation section having the annular shape.

If the rotation-type electric component of the Patent Literature 1 is provided with two or more push switches, an operator may perform so-called double clicking even though he or she intends to give a push operation to the operation shaft only once. In contrast, the push switch may not be easily driven.

CITATION LIST

Patent Literature

Patent Literature 1: JP 4934550 B2 (paragraph [0015])

SUMMARY OF INVENTION

It is an object of the present disclosure to provide: a press-type input device configured to detect pushing force by a detection unit no matter where on a pressure receiving surface of the press-type input device the pushing force is exerted; and a press-rotate-type input device.

A press-type input device according to one aspect of the present disclosure includes a first pressing member, a second pressing member, a base, and a holding member. The first pressing member has a pressure receiving surface and a first axis and is tiltable around the first axis by the pressure receiving surface being pushed. The second pressing member has a second axis and is tiltable around the second axis by being pushed due to a tilt of the first pressing member.

The base includes a detection unit configured to detect a tilt of the second pressing member. The holding member is configured to hold, together with the base, the first pressing member and the second pressing member. A location of at least one of the first axis or the second axis is variable in accordance with a pushed location of the pressure receiving surface. The second axis and the detection unit do not overlap each other when viewed in a direction vertical to the pressure receiving surface.

A press-rotate-type input device according to one aspect of the present disclosure includes the press-type input device, a rotor, and a circuit block. The press-type input device has a cylindrical part. The rotor surrounds the cylindrical part and is rotatable around the cylindrical part. The circuit block is held by the base of the press-type input device and is configured to detect a rotation amount of the rotor.

DESCRIPTION OF EMBODIMENTS

1. First Embodiment

1.1 Schema

Figure 1:
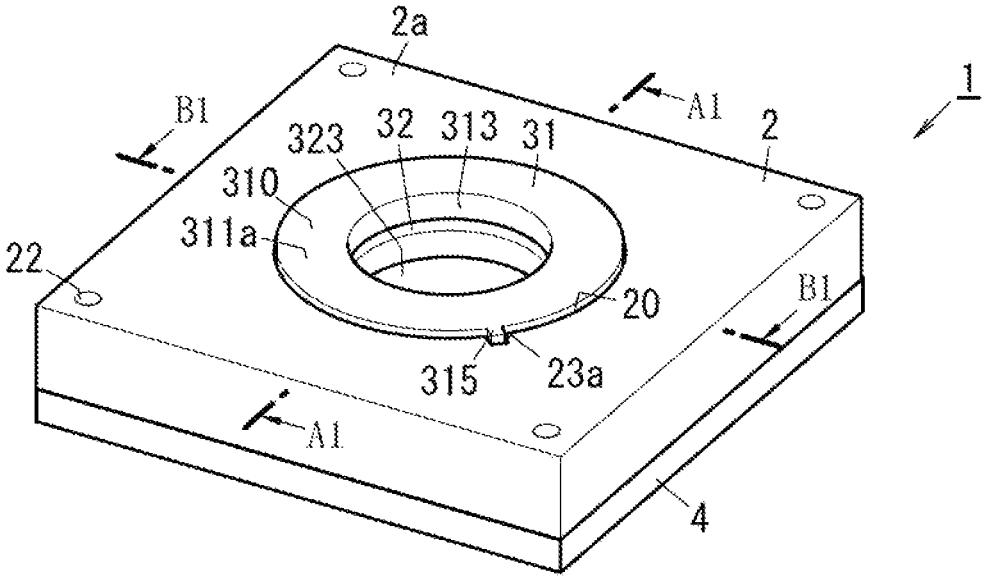
FIG. 1 is a perspective view illustrating a press-type input device of a first embodiment.
Figure 2:
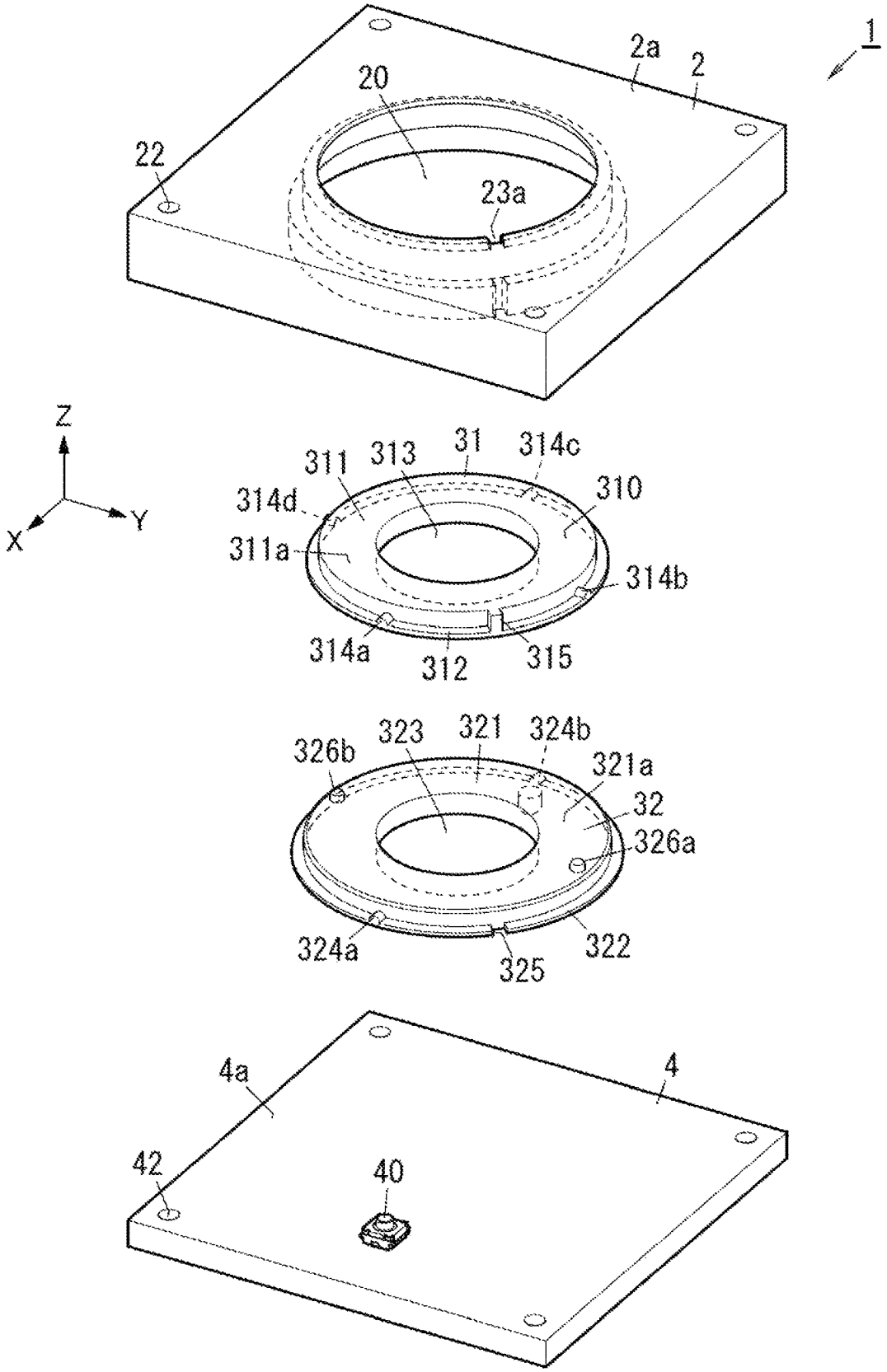
FIG. 2 is an exploded perspective view illustrating the press-type input device viewed from above.
Figure 3:
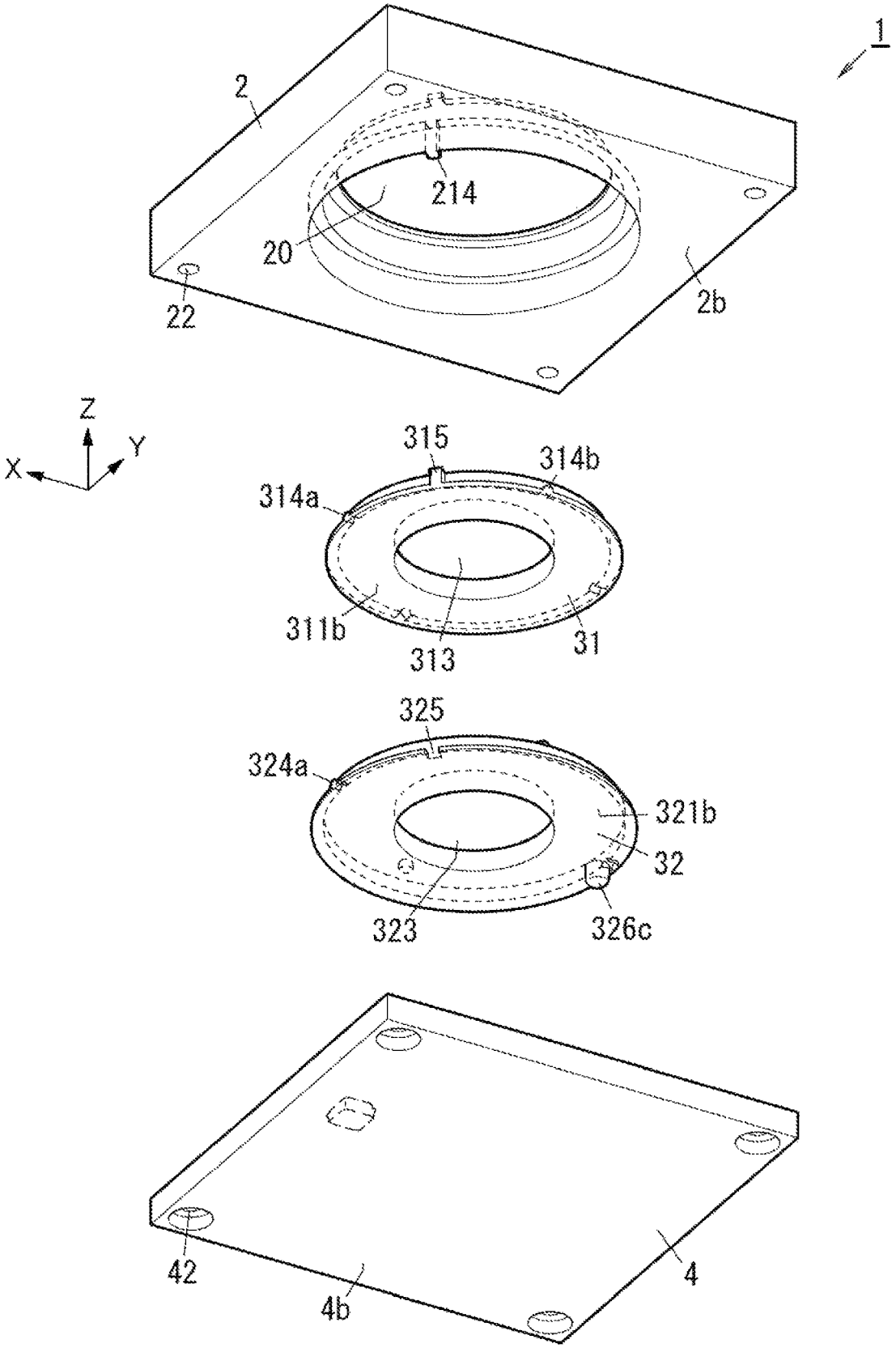
FIG. 3 is an exploded perspective view illustrating the press-type input device viewed from below.

FIGS. 1 to 3 show a press-type input device 1 according to the present embodiment. press-type input device 1 includes a first pressing member 31, a second pressing member 32, a base 4, and a holding member 2.

The first pressing member 31 has a pressure receiving surface 310. The first pressing member 31 has a first axis S1 (see FIGS. 7A to 9). The first pressing member 31 is tiltable around the first axis S1 by the pressure receiving surface 310 being pushed.

The second pressing member 32 has a second axis S2 (see FIGS. 7A to 9). The second pressing member 32 is tiltable around the second axis S2 by being pushed due to a tilt of the first pressing member 31.

The base 4 includes a detection unit 40. The detection unit 40 detects a tilt of the second pressing member 32.

The holding member 2 has an opening 20. The holding member 2 exposes the pressure receiving surface 310 from the opening 20 and holds, together with the base 4, the first pressing member 31 and the second pressing member 32.

The location of at least one of the first axis S1 or the second axis S2 is variable in accordance with a pushed location on the pressure receiving surface 310. The second axis S2 and the detection unit 40 do not overlap each other when viewed in a direction vertical to the pressure receiving surface 310.

In the press-type input device 1, when the pressure receiving surface 310 of the first pressing member 31 is pushed, the first pressing member 31 tilts around the first axis S1. In this embodiment, the location of the first axis S1 varies in accordance with a pushed location on the pressure receiving surface 310, and therefore, a direction in which the first pressing member 31 tilts also varies.

Next, the first pressing member 31 which tilts pushes the second pressing member 32, and the second pressing member 32 then tilts around the second axis S2. In this embodiment, the location of the second axis S2 varies in accordance with a pushed location on the second pressing member 32, and therefore, a direction in which the second pressing member 32 tilts also varies. However, the second axis S2 is present at a location where the second axis S2 does not overlap the detection unit 40 when the press-type input device 1 is viewed in the direction vertical to the pressure receiving surface 310. Thus, the detection unit 40 can detect a tilt of the second pressing member 32.

Thus, according to the press-type input device 1, pushing force is detectable by the detection unit 40 no matter where on the pressure receiving surface 310 the pushing force is exerted.

1.2 Configuration

The press-type input device 1 will be described further in detail below with reference to FIGS. 1 to 9. Note that for convenience of explanation, an X-axis, a Y-axis, and a Z-axis orthogonal to one another are shown in part of each figure. The positive direction of the Z-axis is defined as an upward direction, the negative direction of the Z-axis is defined as a downward direction, but these directions are not intended to limit directions in which the press-type input device 1 is used.

As illustrated in FIGS. 1 to 3, the press-type input device 1 includes the first pressing member 31, the second pressing member 32, the base 4, and the holding member 2. The holding member 2, the first pressing member 31, the second pressing member 32, and the base 4 are arranged parallel to the Z-axis in this order.

Figure 4A:
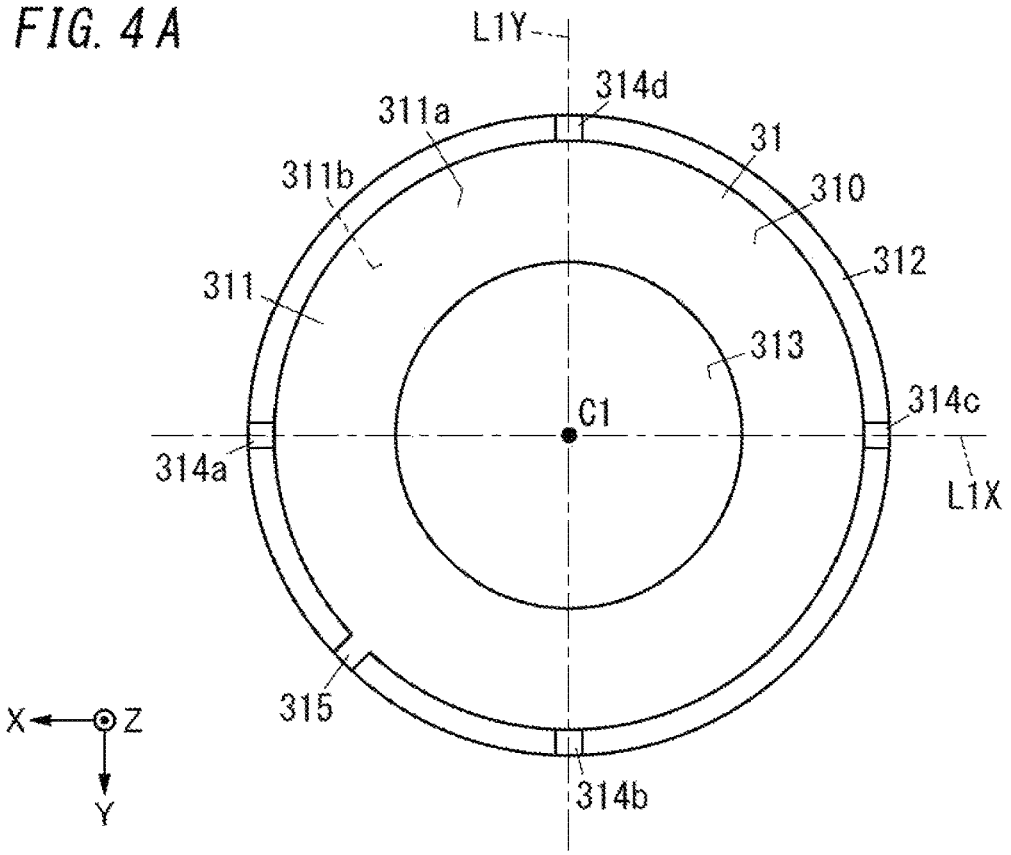
FIG. 4A is a plan view illustrating a first pressing member in the press-type input device.

The first pressing member 31 is, for example, a resin molded body and is electrically insulating. The first pressing member 31 is an annular member. More specifically, the first pressing member 31 includes a body part 311 and a flange 312 as illustrated in FIG. 4A.

The body part 311 of the first pressing member 31 is a disk-shaped member. The body part 311 has a first surface 311*a* and a second surface 311*b*. The first surface 311*a* is in the positive direction of the Z-axis. The second surface 311*b* is in the negative direction of the Z-axis. The first surface 311*a* and the second surface 311*b* are flat surfaces, are parallel to each other, and are respectively front and rear surfaces of the body part 311. The first surface 311*a* and the second surface 311*b* are annular band-like surfaces when viewed along a Z-axis direction. At the center of the body part 311, a through hole 313 which is circular is provided parallel to the Z-axis.

The flange 312 of the first pressing member 31 protrudes parallel to an XY plane from an outer peripheral surface of the body part 311. The flange 312 has a uniform width and a uniform thickness. The flange 312 is provided with four ribs 314*a* to 314*d*. The four ribs 314*a* to 314*d* may form supporting points when the first pressing member 31 tilts.

The four ribs 314*a* to 314*d* protrude in the positive direction of the Z-axis. The two ribs 314*a* and 314*c* are present at symmetrical locations on a straight line L1X which is parallel to the X-axis and which extends through a center C1 of the through hole 313. The remaining two ribs 314*b* and 314*d* are present at symmetrical locations on a straight line L1Y which is parallel to the Y-axis and which extends through the center C1 of the through hole 313. The four ribs 314*a* to 314*d* are present at locations which are in the XY plane and which are symmetrical to each other about the center C1 of the through hole 313. The four ribs 314*a* to 314*d* are arranged at equal intervals along the flange 312. The flange 312 is further provided with a projection 315.

The first pressing member 31 has the pressure receiving surface 310. The pressure receiving surface 310 is the first surface 311*a* of the body part 311. The pressure receiving surface 310 is a surface which receives force in the negative direction of the Z-axis from the outside of the press-type input device 1.

Figure 4B:
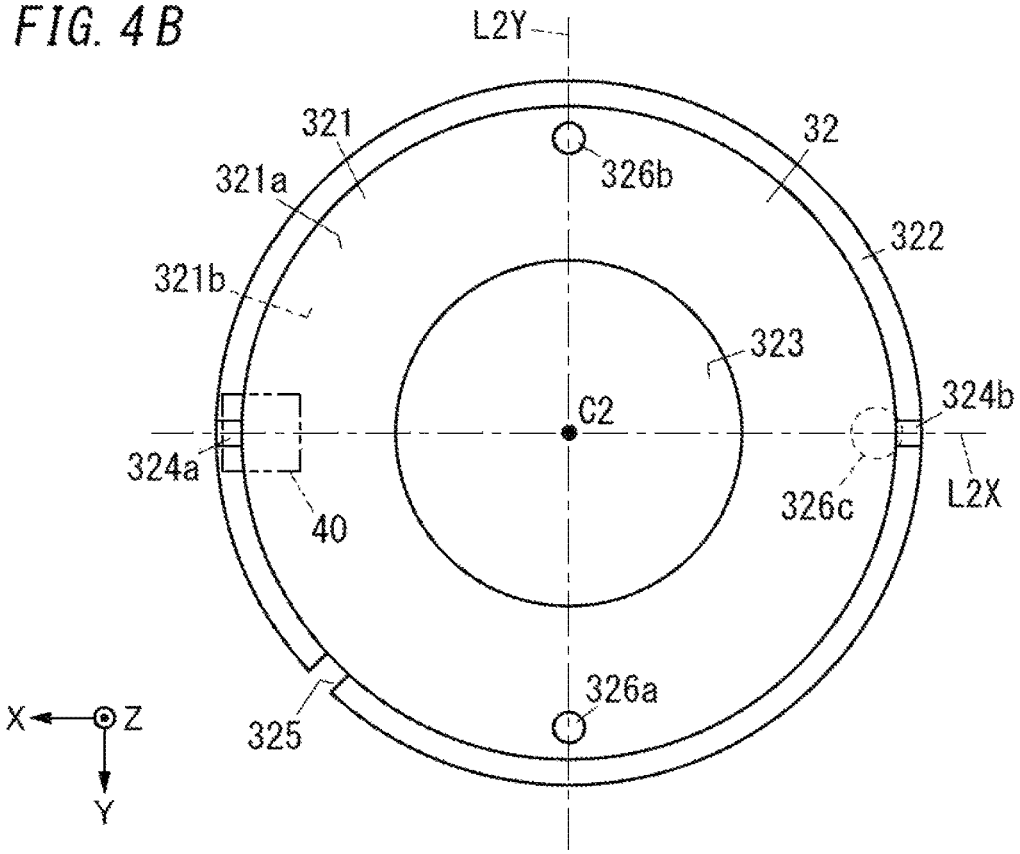
FIG. 4B is a plan view illustrating a second pressing member in the press-type input device.

The second pressing member 32 is, for example, a resin molded body and is electrically insulating. The second pressing member 32 is an annular member. More specifically, the second pressing member 32 includes a body part 321 and a flange 322 as illustrated in FIG. 4B.

The body part 321 of the second pressing member 32 is a disk-shaped member. The body part 321 has a first surface 321*a* and a second surface 321*b*. The first surface 321*a* is in the positive direction of the Z-axis. The second surface 321*b* is in the negative direction of the Z-axis. The first surface 321*a* and the second surface 321*b* are flat surfaces, are parallel to each other, and are respectively front and rear surfaces of the body part 321. The first surface 321*a* and the second surface 321*b* are annular band-like surfaces when viewed along the Z-axis direction. At the center of the body part 321, a through hole 323 which is circular is provided parallel to the Z-axis. In this embodiment, the inner diameter of the through hole 323 of the second pressing member 32 is equal to the inner diameter of the through hole 313 of the first pressing member 31.

The first surface 321*a* of the body part 321 of the second pressing member 32 is provided with two bosses 326*a* and 326*b*. The two bosses 326*a* and 326*b* may form supporting points when the first pressing member 31 and the second pressing member 32 tilt. The two bosses 326*a* and 326*b* each has a tip end which is hemispherical. The two bosses 326*a* and 326*b* protrude in the positive direction of the Z-axis. The two bosses 326*a* and 326*b* are present at symmetrical locations on a straight line L2Y which is parallel to the Y-axis and which extends through a center C2 of the through hole 323.

The flange 322 of the second pressing member 32 protrudes from an outer peripheral surface of the body part 321 parallel to the XY plane. The flange 322 has a uniform width. The flange 322 is provided with two ribs 324*a* and 324*b*. The two ribs 324*a* and 324*b* protrude in the positive direction of the Z-axis. The two ribs 324*a* and 324*b* are present at symmetrical locations on a straight line L2X which is parallel to the X-axis and which extends through the center C2 of the through hole 323. The rib 324*b* tilts in the negative direction of the Z-axis as the distance from the center C2 increases (see FIG. 6A). The flange 322 is further provided with a recess 325.

The second surface 321*b* of the body part 321 of the second pressing member 32 is provided with one boss 326*c*. The boss 326*c* may form a supporting point when the second pressing member 32 tilts. The boss 326*c* has a tip end which is hemispherical. The boss 326*c* protrudes in the negative direction of the Z-axis. The boss 326*c* and the detection unit 40 provided to the base 4 are present at symmetrical locations on the straight line L2X which is parallel to the X-axis and which extends through the center C2 of the through hole 323.

In this embodiment, the size of an outer peripheral circle of the flange 312 of the first pressing member 31 is equal to the size of an outer peripheral circle of the body part 321 of the second pressing member 32. In addition, an outer peripheral circle of the flange 322 of the second pressing member 32 is larger than the outer peripheral circle of the flange 312 of the first pressing member 31. That is, the second pressing member 32 is slightly larger than the first pressing member 31.

The base 4 is, for example, a resin molded body and is electrically insulating. As illustrated in FIGS. 2 and 3, the base 4 is a member having a rectangular plate shape. The base 4 has a first surface 4*a* and a second surface 4*b*. The first surface 4*a* is in the positive direction of the Z-axis. The second surface 4*b* is in the negative direction of the Z-axis. The first surface 4*a* and the second surface 4*b* are flat surfaces, are parallel to each other, and are respectively front and rear surfaces of the base 4.

The base 4 includes the detection unit 40. The detection unit 40 is provided to the first surface 4*a* of the base 4. More specifically, the detection unit 40 is provided at a location where the detection unit 40 faces the second surface 321*b* of the second pressing member 32 in the Z-axis direction. The detection unit 40 detects the tilt of the second pressing member 32. The detection unit 40 is a push switch. In this case, when the second pressing member 32 tilts and pushes the detection unit 40, the detection unit 40 detects the tilt of the second pressing member 32. Alternatively, the detection unit 40 may be a photoelectric sensor such as a photo interrupter. This case will be described in a fifth embodiment.

Two or more detection units 40 may be provided, but in the present embodiment, one detection unit 40 is provided. As compared to a case where two or more detection units 40 are provided, multiple clicks, such as double clicks can be reduced.

The holding member 2 is, for example, a resin molded body and is electrically insulating. As illustrated in FIGS. 2 and 3, the holding member 2 is a member which is a rectangular parallelepiped. The holding member 2 has a first surface 2*a* and a second surface 2*b*. The first surface 2*a* is in the positive direction of the Z-axis. The second surface 2*b* is in the negative direction of the Z-axis. The first surface 2*a* and the second surface 2*b* are flat surfaces, are parallel to each other, and are respectively front and rear surfaces of the holding member 2. The holding member 2 has the opening 20. The opening 20 is provided in the first surface 2*a* of the holding member 2.

The opening 20 has a circular shape having a size the same as the size of an outer peripheral circle of the body part 311 of the first pressing member 31. Alternatively, the opening 20 may be larger than the outer peripheral circle of the body part 311 of the first pressing member 31 and smaller than the outer peripheral circle of the flange 312 of the first pressing member 31.

Figure 5A:
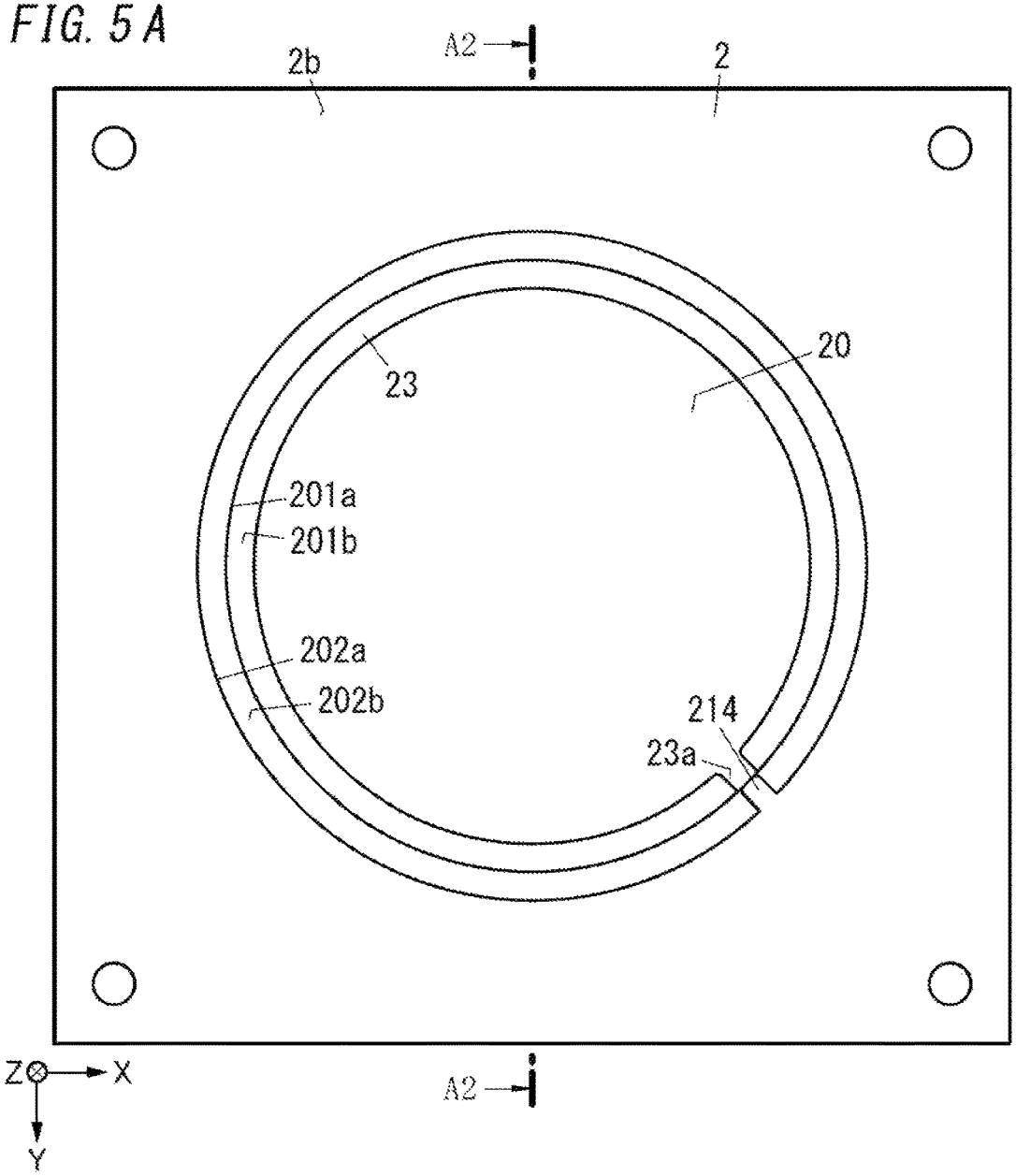
FIG. 5A is a bottom view illustrating a holding member in the press-type input device.
Figure 5B:
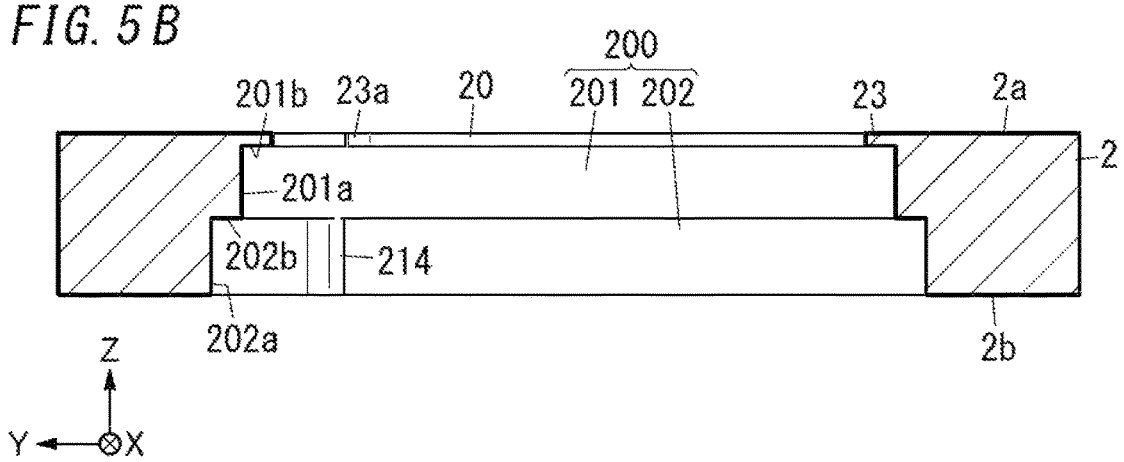
FIG. 5B is a sectional view taken along line A2-A2 of FIG. 5A.

As illustrated in FIGS. 5A and 5B, the holding member 2 has a housing section 200. The housing section 200 includes a first housing section 201 and a second housing section 202. The first housing section 201 is a columnar space. The second housing section 202 is a columnar space having a larger inner diameter than the first housing section 201. The opening 20, the first housing section 201, and the second housing section 202 are aligned parallel to the Z-axis in this order and are communicated with each other.

The first housing section 201 of the holding member 2 has a first inner peripheral surface 201*a* and a first bottom surface 201*b*. The first bottom surface 201*b* is an annular band-like surface when viewed along the Z-axis direction. An inner flange 23 protrudes from the first inner peripheral surface 201*a* parallel to the XY plane. The inner flange 23 has a uniform width and a uniform thickness. The first bottom surface 201*b* is a surface of the inner flange 23, the surface being in the negative direction of the Z-axis. The inner flange 23 has a surface which is in the positive direction of the Z-axis and which is flush with the first surface 2*a*. The opening 20 is surrounded by a tip end of the inner flange 23. The inner flange 23 further has a recess 23*a*. The projection 315 of the first pressing member 31 can be fit in the recess 23*a*.

The second housing section 202 of the holding member 2 has a second inner peripheral surface 202*a* and a second bottom surface 202*b*. The second bottom surface 202*b* is annular band-like surfaces when viewed along the Z-axis direction and is in the negative direction of the Z-axis. In addition, the second inner peripheral surface 202*a* is provided with a projection 214. The projection 214 can be fit into the recess 325 of the second pressing member 32.

Figure 6A:
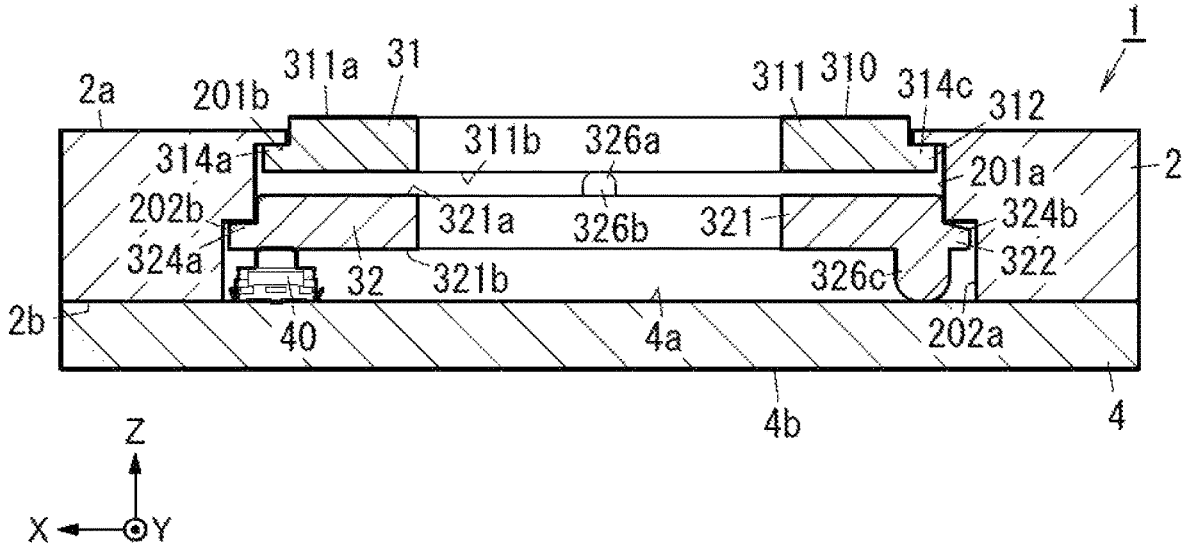
FIG. 6A is a sectional view taken along line A1-A1 of FIG. 1.
Figure 6B:
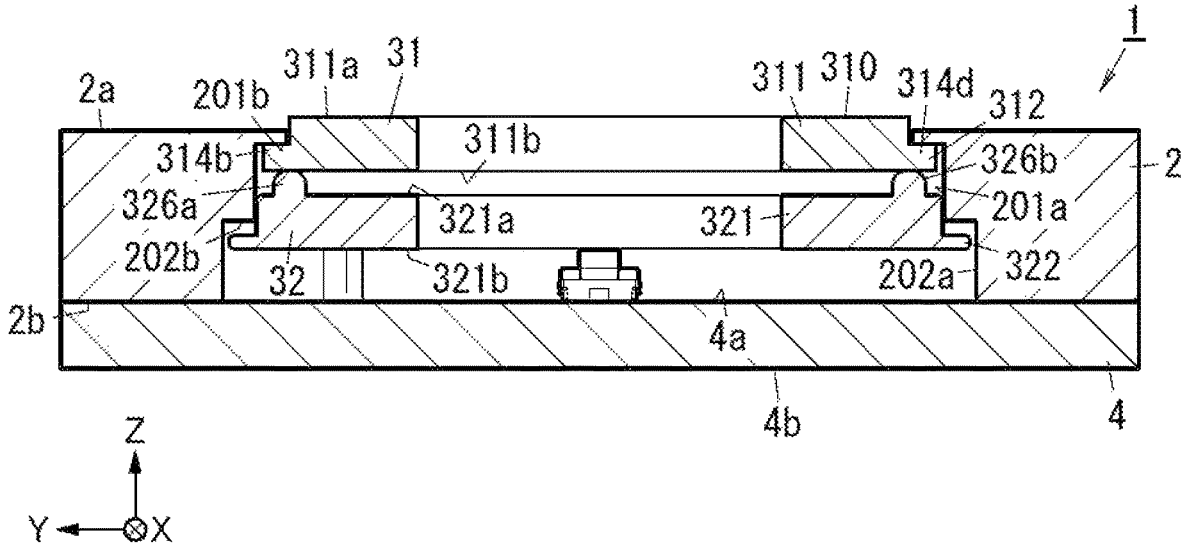
FIG. 6B is a sectional view taken along line B1-B1 of FIG. 1.

As illustrated in FIGS. 6A and 6B, the first inner peripheral surface 201*a* has a circular shape having substantially the same as the size of the outer peripheral circle of the flange 312 of the first pressing member 31. Alternatively, the inner diameter of the first inner peripheral surface 201*a* may be larger than the outer peripheral circle of the flange 312 of the first pressing member 31.

The first inner peripheral surface 201*a* has a circular shape having substantially the same as the size of the outer peripheral circle of the body part 321 of the second pressing member 32. Alternatively, the inner diameter of the first inner peripheral surface 201*a* may be larger than the outer peripheral circle of the body part 321 of the second pressing member 32.

The second inner peripheral surface 202*a* has a circular shape having substantially the same as the size of the outer peripheral circle of the flange 322 of the second pressing member 32. Alternatively, the inner diameter of the second inner peripheral surface 202*a* may be larger than the outer peripheral circle of the flange 322 of the second pressing member 32.

In the holding member 2, the first surface 2*a*, the first bottom surface 201*b*, the second bottom surface 202*b*, and the second surface 2*b* are parallel surfaces. As illustrated in FIG. 5B, the first bottom surface 201*b*, the first inner peripheral surface 201*a*, the second bottom surface 202*b*, the second inner peripheral surface 202*a*, and the second surface 2*b* form a staircase shape.

As illustrated in FIG. 1, the holding member 2 exposes the pressure receiving surface 310 from the opening 20. As illustrated in FIGS. 6A and 6B, the holding member 2 holds, together with the base 4, the first pressing member 31 and the second pressing member 32. As illustrated in FIGS. 2 and 3, the holding member 2 has through holes 22 at four corners thereof. The base 4 has through holes 42 at four corners thereof. The holding member 2 and the base 4 can be connected to each other by, for example, screws and the like inserted into the through holes 22 and 42.

1.3 Assembly

Next, an assembling method of the press-type input device 1 will be described.

First, the first pressing member 31 is accommodated in the housing section 200 of the holding member 2. At this time, the projection 315 of the first pressing member 31 is fit into the recess 23*a* formed in the holding member 2. This reduces positional displacement of the first pressing member 31 in the circumferential direction. The "positional displacement in the circumferential direction" refers to positional displacement around a straight line which is parallel to the Z-axis and which extends through the center of the opening 20. Note that the straight line which is parallel to the Z-axis and which extends through the center of the opening 20 extends through the center C1 of the through hole 313 and the center C2 of the through hole 323.

Second, the second pressing member 32 is accommodated in the housing section 200 of the holding member 2. At this time, the projection 214 of the holding member 2 is fit into the recess 325 of the second pressing member 32. This reduces positional displacement of the second pressing member 32 in the circumferential direction.

Next, in a state where the first pressing member 31 and the second pressing member 32 are accommodated in the housing section 200 of the holding member 2, the second surface 2*b* of the holding member 2 is placed on the first surface 4*a* of the base 4, and the holding member 2 and the base 4 are coupled to each other. The holding member 2 and the base 4 are coupled to each other by, for example, inserting screws and the like into the through holes 22 of the holding member 2 and the through holes 42 of the base 4. The press-type input device 1 shown in FIG. 1 is thus assembled.

As illustrated in FIGS. 6A and 6B, in the press-type input device 1, the four ribs 314*a* to 314*d* of the first pressing member 31 are in contact with the first bottom surface 201*b* of the holding member 2. The flange 312 (a portion where the four ribs 314*a* to 314*d* are not provided) of the first pressing member 31 is not in contact with the first bottom surface 201*b*. Thus, along the direction (a direction parallel to the Z-axis) vertical to the pressure receiving surface 310, the first pressing member 31 is in contact with the first bottom surface 201*b* of the holding member 2 at four points in total (in the present embodiment, at the four ribs 314*a* to 314*d*).

As illustrated in FIG. 6B, in the press-type input device 1, the two bosses 326*a* and 326*b* of the second pressing member 32 are in contact with the second surface 311*b* of the first pressing member 31. Thus, the first pressing member 31 and the second pressing member 32 are in contact with each other at two points. The second surface 311*b* of the first pressing member 31 and the first surface 321*a* of the second pressing member 32 are not in contact with each other. Thus, the first pressing member 31 and the second pressing member 32 are disposed spaced apart from each other by the two bosses 326*a* and 326*b*. As illustrated in FIG. 6A, the two ribs 324*a* and 324*b* of the second pressing member 32 are further in contact with the second bottom surface 202*b* of the holding member 2. The flange 322 (a portion where the two ribs 324*a* and 324*b* are not provided) of the second pressing member 32 is not in contact with the second bottom surface 202*b*. The ribs 324*a* and 324*b* are provided so that the holding member 2 holds the second pressing member 32 in such a way that the second pressing member 32 neither moves upward (in the positive direction of the Z-axis) nor wobbles in a state where the pressure receiving surface 310 is not pushed. The ribs 314*b* and 314*d* of the first pressing member 31 are disposed on substantially opposite sides of the first pressing member 31 from locations where the bosses 326*a* and 326*b* of the second pressing member 32 respectively come into contact with the first pressing member 31, and therefore, the second pressing member 32 is supported by the bosses 326*a* and 326*b* via the first pressing member 31 in a pushing direction (the negative direction of the Z-axis). The second pressing member 32 is supported at four points in addition to the two ribs 324*a* and 324*b* in the pushing direction (the negative direction of the Z-axis).

As illustrated in FIG. 6A, in the press-type input device 1, the boss 326*c* of the second pressing member 32 is in contact with the first surface 4*a* of the base 4. On the other hand, the detection unit 40 of the base 4 is in contact with the second surface 321*b* of the second pressing member 32. Thus, along the direction vertical to the pressure receiving surface 310, the second pressing member 32 and the base 4 are in contact with each other at two points including the detection unit 40. As illustrated in FIG. 4B, the boss 326*c* of the second pressing member 32 and the detection unit 40 provided to the base 4 are present at symmetrical locations on the straight line L2X which is parallel to the X-axis and which extends through the center C2 of the through hole 323. As illustrated in FIGS. 6A and 6B, the second surface 321*b* of the second pressing member 32 and the first surface 4*a* of the base 4 are not in contact with each other. Thus, the second pressing member 32 and the base 4 are disposed apart from each other.

A line segment (a line segment of the straight line L2Y) connecting two contact points (apexes of the two bosses 326*a* and 326*b*) of the first pressing member 31 and the second pressing member 32 and a line segment (a line segment of the straight line L2X) connecting two contact points of the second pressing member 32 and the base 4 intersect each other (see FIG. 4B). The line segment (the line segment of the straight line L2X) connecting the two contact points of the second pressing member 32 and the base 4 is a bisector of the line segment (the line segment of the straight line L2Y) connecting the two contact points of the first pressing member 31 and the second pressing member 32. These two line segments are orthogonal to each other at the center C2. Moreover, the distance between the boss 326*a* and the center C2 is equal to the distance between the boss 326*b* and the center C2.

When viewed in the direction (the direction parallel to the Z-axis) vertical to the pressure receiving surface 310, the bosses 326*a*, 326*b*, and 326*c* are arranged substantially adjacent to the outer peripheral circle of the body part 321 of the second pressing member 32. When locations of the apexes of the bosses 326*a*, 326*b*, and 326*c* and a location where the pushing force is exerted on the detection unit 40 are connected, a substantially square shape is formed. Thus, the two contact points of the first pressing member 31 and the second pressing member 32 and the two contact points of the second pressing member 32 and the base 4 are located at apexes of the substantially square shape.

In addition, the four ribs 314*a* to 314*d* of the first pressing member 31 are respectively arranged to substantially overlap the location where the pushing force is exerted on the detection unit 40, the apex of the boss 326*a*, the apex of the boss 326*c*, and the apex of the boss 326*b*. Thus, when viewed in the direction vertical to the pressure receiving surface 310, the four contact points of the first pressing member 31 and the holding member 2 overlap the two contact points of the first pressing member 31 and the second pressing member 32 and the two contact points of the second pressing member 32 and the base 4.

As illustrated in FIGS. 6A and 6B, in a state where the pressure receiving surface 310 is not pushed, the first surface 311*a* and the second surface 311*b* of the first pressing member 31, the first surface 321*a* and the second surface 321*b* of the second pressing member 32, and the first surface 4*a* of the base 4 are all parallel to one another. In this state, the detection unit 40 do not detect the tilt of the second pressing member 32 though the second surface 321*b* of the second pressing member 32 is in contact with the detection unit 40.

When the press-type input device 1 is viewed from the positive to negative direction of the Z-axis, the first surface 4*a* of the base 4 is viewed through the through hole 313 and the through hole 323. At least viewed part of the base 4 may be transparent. In this case, the detection unit 40 is not viewed through the through hole 313 and the through hole 323 (see FIG. 6A).

1.4 Operation

Next, operation of the press-type input device 1 will be described with reference to FIGS. 7A to 9. FIGS. 7A to 9 are views schematically illustrating operation of the first pressing member 31 and the second pressing member 32 when the press-type input device 1 is viewed from the positive to negative direction of the Z-axis. In FIGS. 7A to 9, a point O represents the center of the opening 20, a point P is the location of the detection unit 40 (in the present embodiment, the push switch), and a point Q is a location where the pressure receiving surface 310 is pushed (the location of a working point). A line segment OP is an initial line, a line segment OQ is a moving radius, and an angle anticlockwise formed between the line segment OP and the line segment OQ in the XY plane is denoted by θ.

Figure 7A:
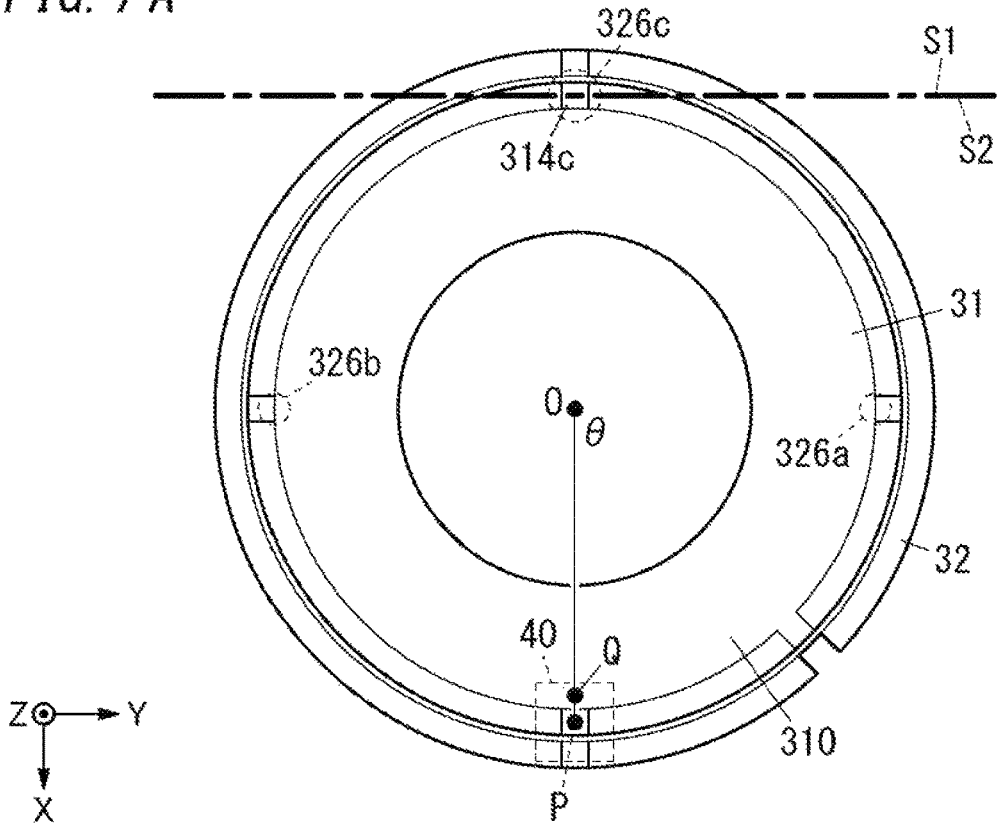
FIG. 7A and FIG. 7B are views each schematically illustrating operation of the press-type input device.

FIG. 7A shows a case where θ is 0°. In this case, when the point Q on the pressure receiving surface 310 of the first pressing member 31 is pushed, the first axis S1 which is parallel to the Y-axis and which extends through the rib 314*c* present at a location symmetrical to the point Q about the point O appears, and the first pressing member 31 tilts around the first axis S1. As the first pressing member 31 tilts, the two bosses 326*a* and 326*b* move in the negative direction of the Z-axis. Then, the second axis S2 which is parallel to the Y-axis and which extends through the boss 326*c* appears, and the second pressing member 32 tilts around the second axis S2. As a result, the second pressing member 32 pushes the detection unit 40, and the detection unit 40 detects the tilt of the second pressing member 32.

As illustrated in FIG. 7A, when the point Q is located near the outer perimeter of the pressure receiving surface 310, a straight line (not shown) connecting apexes of the two bosses 326*a* and 326*b* which are contact points of the first pressing member 31 and the second pressing member 32 is located at substantially one-half of the distance from the first axis S1 to the point Q and is located at substantially one-half of the distance from the second axis S2 to the point P. Thus, a pushing load and a stroke at the point Q is substantially the same as a pushing load and a stroke at the detection unit 40.

Figure 7B:
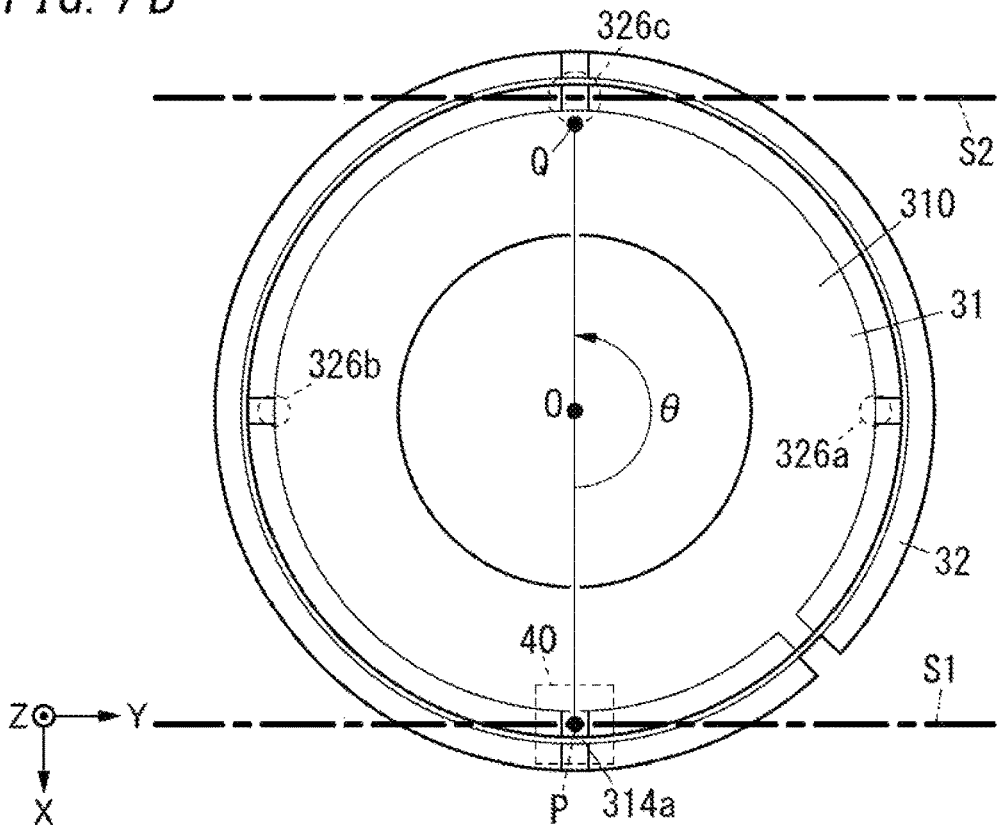

FIG. 7B shows a case where θ is 180°. In this case, when the point Q on the pressure receiving surface 310 of the first pressing member 31 is pushed, a first axis S1 which is parallel to the Y-axis and which extends through the rib 314*a* present at a location symmetrical to the point Q about the point O appears, and the first pressing member 31 tilts around the first axis S1. As the first pressing member 31 tilts, the two bosses 326*a* and 326*b* move in the negative direction of the Z-axis. Then, a second axis S2 which is parallel to the Y-axis and which extends through the boss 326*c* appears, and the second pressing member 32 tilts around the second axis S2. As a result, the second pressing member 32 pushes the detection unit 40, and the detection unit 40 detects the tilt of the second pressing member 32.

As illustrated in FIG. 7B, when the point Q is located near the outer perimeter of the pressure receiving surface 310, a straight line (not shown) connecting apexes of the two bosses 326*a* and 326*b* which are contact points of the first pressing member 31 and the second pressing member 32 is located at substantially one-half of the distance from the first axis S1 to the point Q and is located at substantially one-half of the distance from the second axis S2 to the point P. Thus, a pushing load and a stroke at the point Q is substantially the same as a pushing load and a stroke at the detection unit 40.

Figure 8A:
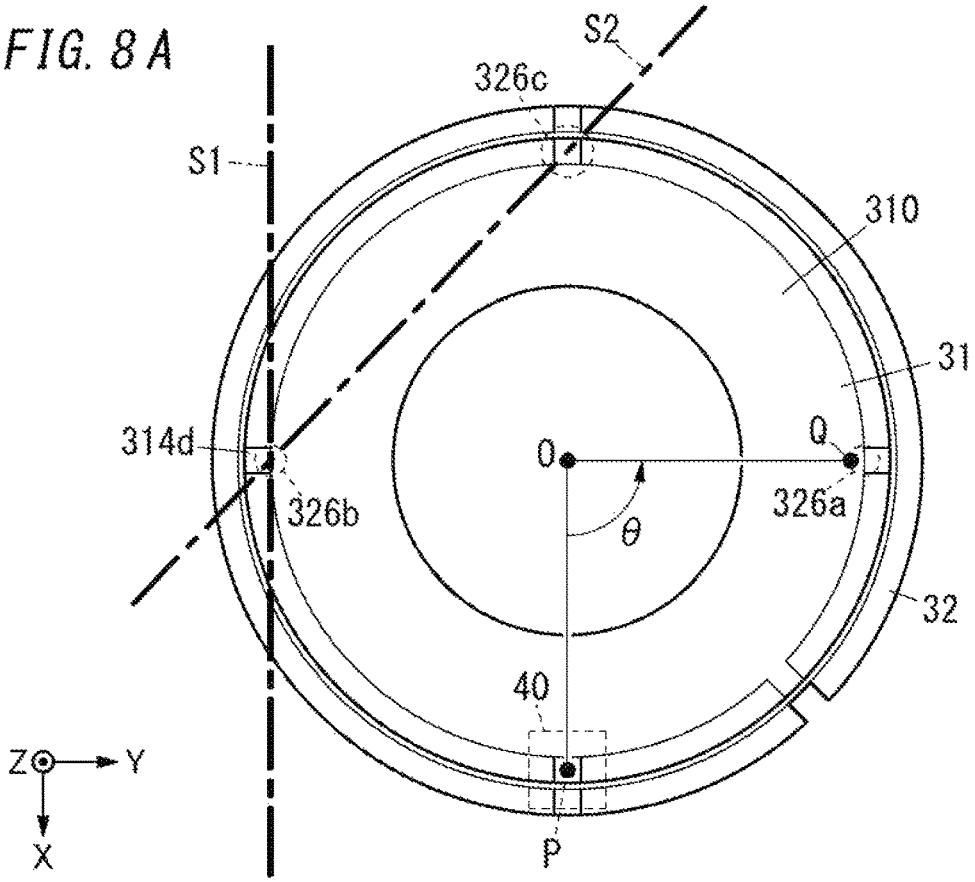
FIG. 8A and FIG. 8B are views each schematically illustrating operation of the press-type input device.

FIG. 8A shows a case where θ is 90°. In this case, when the point Q on the pressure receiving surface 310 of the first pressing member 31 is pushed, a first axis S1 which is parallel to the X-axis and which extends through the rib 314*d* present at a location symmetrical to the point Q about the point O appears, and the first pressing member 31 tilts around the first axis S1. As the first pressing member 31 tilts, the boss 326*a* moves in the negative direction of the Z-axis. Then, a second axis S2 extending through the two bosses 326*b* and 326*c* appears, and the second pressing member 32 tilts around the second axis S2. As a result, the second pressing member 32 pushes the detection unit 40, and the detection unit 40 detects the tilt of the second pressing member 32. Note that the distance from the point P to the second axis S2 is equal to the distance from the point Q to the second axis S2.

As illustrated in FIG. 8A, when the point Q is located near the outer perimeter of the pressure receiving surface 310, force pushing the point Q is substantially directly transmitted to the boss 326*a* of the second pressing member 32. The distance from the second axis S2 to the boss 326*a* is substantially equal to the distance from the second axis S2 to the point P. Thus, a pushing load and a stroke at the point Q is substantially the same as a pushing load and a stroke at the detection unit 40. Note that, although not shown, operation in the case of θ being 270° is symmetrical to the operation in the case of θ being 90° about a straight line which is parallel to the X-axis and which extends through the point O.

Figure 8B:
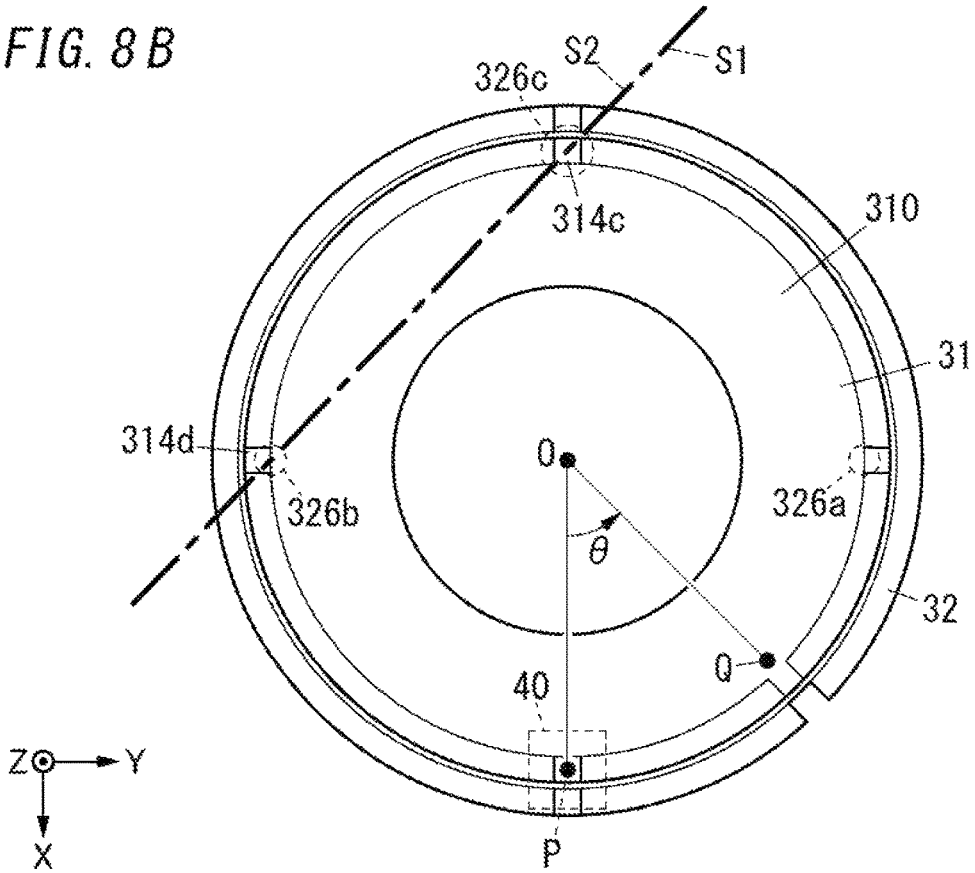

FIG. 8B shows a case where θ is 45°. In this case, when the point Q on the pressure receiving surface 310 of the first pressing member 31 is pushed, a first axis S1 extending through the ribs 314*c* and 314*d* appears, and the first pressing member 31 tilts around the first axis S1. As the first pressing member 31 tilts, the boss 326*a* moves in the negative direction of the Z-axis. Then, a second axis S2 extending through the two bosses 326*b* and 326*c* appears, and the second pressing member 32 tilts around the second axis S2. As a result, the second pressing member 32 pushes the detection unit 40, and the detection unit 40 detects the tilt of the second pressing member 32.

As illustrated in FIG. 8B, when the point Q is located near the outer perimeter of the pressure receiving surface 310, the distance from the first axis S1 to the point Q is about 1.2 times the distance from the first axis S1 to the boss 326*a*. Moreover, the distance from the second axis S2 to the boss 326*a* is substantially equal to the distance from the second axis S2 to the point P. Thus, the pushing load at the point Q is about 0.8 times the pushing load at the detection unit 40. Moreover, the stroke at the point Q is about 1.2 times the stroke at the detection unit 40. Note that, although not shown, operation in the case of θ being 315° is symmetrical to the operation in the case of θ being 45° about a straight line which is parallel to the X-axis and which extends through the point O.

Figure 9:
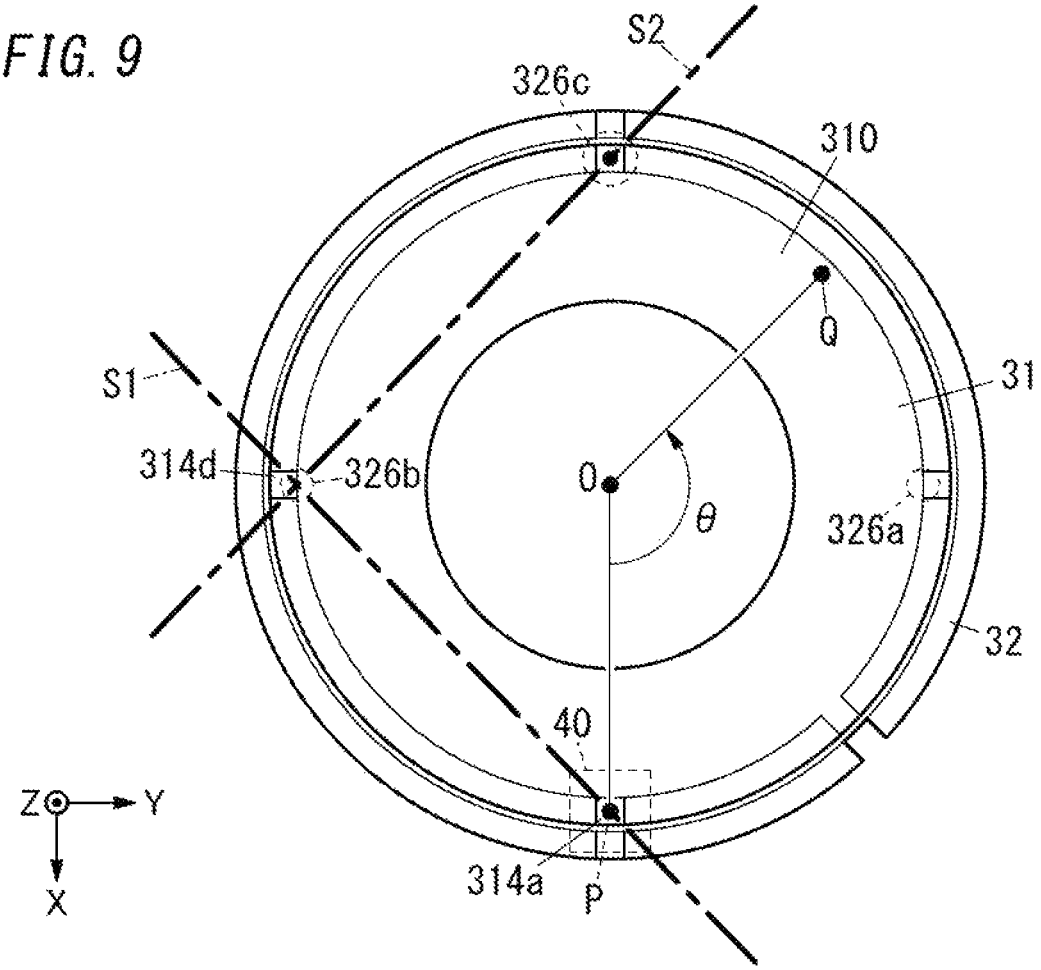
FIG. 9 is a view schematically illustrating operation of the press-type input device.

FIG. 9 shows a case where θ is 135°. In this case, when the point Q on the pressure receiving surface 310 of the first pressing member 31 is pushed, a first axis S1 extending through the ribs 314*a* and 314*d* appears, and the first pressing member 31 tilts around the first axis S1. As the first pressing member 31 tilts, the boss 326*a* moves in the negative direction of the Z-axis. Then, a second axis S2 extending through the two bosses 326*b* and 326*c* appears, and the second pressing member 32 tilts around the second axis S2. As a result, the second pressing member 32 pushes the detection unit 40, and the detection unit 40 detects the tilt of the second pressing member 32.

As illustrated in FIG. 9, when the point Q is located near the outer perimeter of the pressure receiving surface 310, the distance from the first axis S1 to the point Q is about 1.2 times the distance from the first axis S1 to the boss 326*a*. Moreover, the distance from the second axis S2 to the boss 326*a* is substantially equal to the distance from the second axis S2 to the point P. Thus, the pushing load at the point Q is about 0.8 times the pushing load at the detection unit 40. Moreover, the stroke at the point Q is about 1.2 times the stroke at the detection unit 40. Note that, although not shown, operation in the case of θ being 225° is symmetrical to the operation in the case of θ being 135° about a straight line which is parallel to the X-axis and which extends through the point O.

As described above, the first pressing member 31 has the first axis S1. The first axis S1 is not a fixed axis. In other words, the location of the first axis S1 is variable in accordance with a pushed location on the pressure receiving surface 310. That is, the first pressing member 31 is tiltable around the first axis S1 by the pressure receiving surface 310 being pushed.

The second pressing member 32 has the second axis S2. The second axis S2 is also not a fixed axis. In other words, the location of the second axis S2 is variable in accordance with a pushed location on the pressure receiving surface 310. That is, the second pressing member 32 is tiltable around the second axis S2 by being pushed due to the tilt of the first pressing member 31.

Note that when viewed in the direction (the Z-axis direction) vertical to the pressure receiving surface 310, the second axis S2 and the detection unit 40 do not overlap each other. If the second axis S2 and the detection unit 40 overlapped each other, the detection unit 40 could not detect the tilt of the second pressing member 32 even when the second pressing member 32 tilts around the second axis S2.

In practice, θ may be any angle. Moreover, as long as the point Q is present on the pressure receiving surface 310, the line segment OQ may also have any length.

According to the press-type input device 1 of the present embodiment, pushing force is detectable by the detection unit 40 no matter where on the pressure receiving surface 310 the pushing force is exerted. Note that the pressure receiving surface 310 may be fully pressed. In this case, the first pressing member 31 does not tilt but moves in the negative direction of the Z-axis, and the first pressing member 31 pushes the two bosses 326*a* and 326*b* in the negative direction of the Z-axis. Then, a second axis S2 which is parallel to the Y-axis and which extends through the rib 324*b* and the boss 326*c* appears, and the second pressing member 32 tilts around the second axis S2 in a similar manner to the case shown in FIG. 7A or FIG. 7B. As a result, the second pressing member 32 pushes the detection unit 40, and the detection unit 40 detects the tilt of the second pressing member 32. In particular, when the point Q is located near the outer perimeter of the pressure receiving surface 310, a push operation (the pushing load and the stroke) given to the pressure receiving surface 310 can be, substantially as it is, transmitted as a push operation (the pushing load and the stroke) given to the detection unit 40 in four directions where θ is 0°, 90°, 180°, and 270°.

2. Second Embodiment

2.1 Configuration

Figure 10:
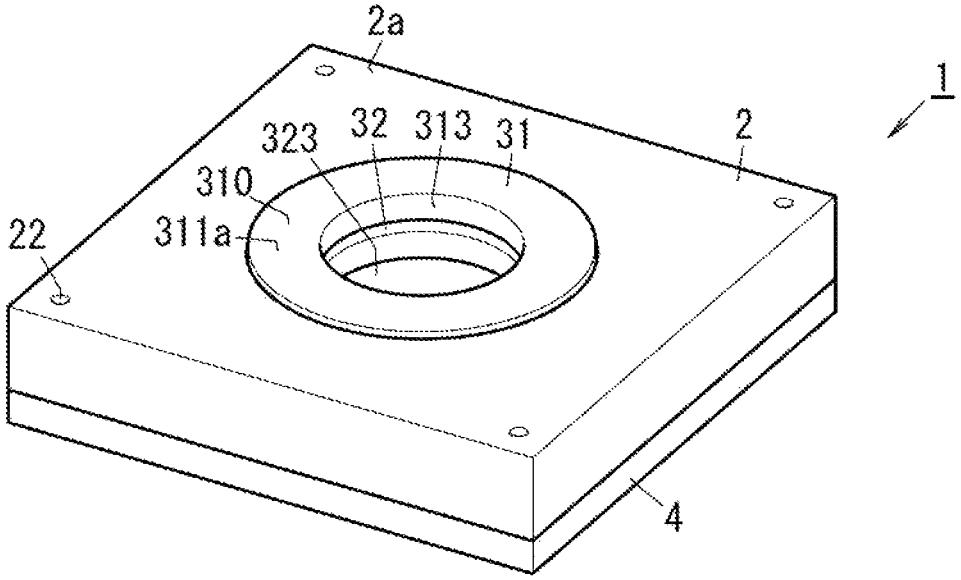
FIG. 10 is a perspective view illustrating a press-type input device of a second embodiment.
Figure 11:
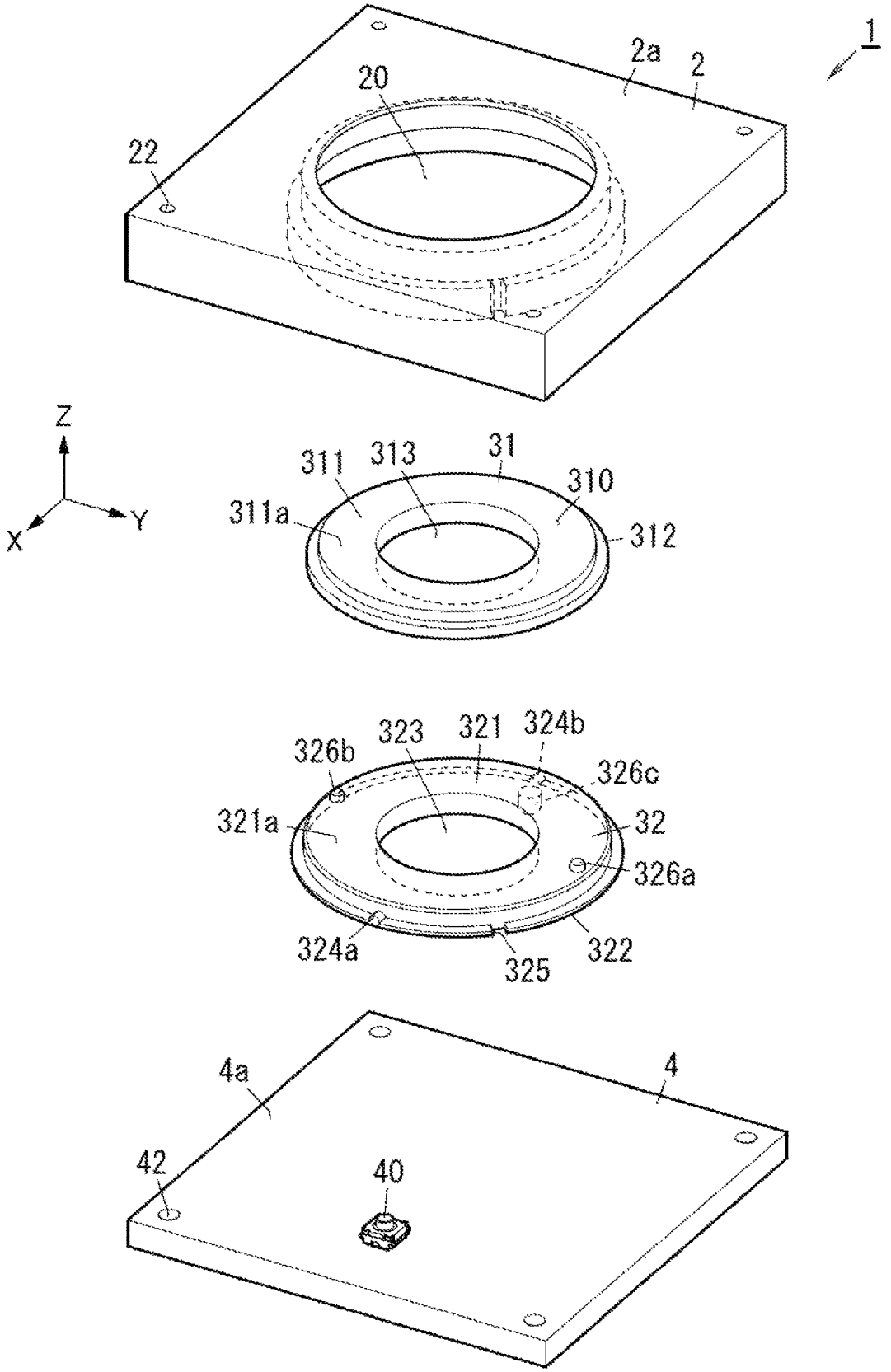
FIG. 11 is an exploded perspective view illustrating the press-type input device of the second embodiment.

FIGS. 10 and 11 show a press-type input device 1 according to the present embodiment. Note that components similar to those in the press-type input device 1 of the first embodiment are denoted by the same reference signs, and the description thereof will be omitted.

Mainly, in the present embodiment, the configuration of a first pressing member 31 is different from the configuration of the first pressing member 31 in the press-type input device 1 according to the first embodiment. Specifically, the first pressing member 31 of the present embodiment is not provided with four ribs 314*a* to 314*d* as illustrated in FIG. 11. Therefore, in a state where a pressure receiving surface 310 is not pushed, a flange 312 of the first pressing member 31 is in contact with a first bottom surface 201*b* of a holding member 2. That is, along a direction (a Z-axis direction) vertical to the pressure receiving surface 310, the first pressing member 31, which has a circular or elliptical (in the present embodiment, a circular) shape in the form of a ring, is in contact with the holding member 2. The center of the circular or elliptical shape is a midpoint of two contact points of the first pressing member 31 and a second pressing member 32. The midpoint of the two contact points is a midpoint between two bosses 326*a* and 326*b*. Thus, a holding state of the first pressing member 31 and the second pressing member 32 is further stabilized.

Moreover, when viewed in the direction (the Z-axis direction) vertical to the pressure receiving surface 310, a contact surface (in the present embodiment, an annular surface of the flange 312) of the first pressing member 31 and the holding member 2 overlaps the two contact points of the first pressing member 31 and the second pressing member 32 and two contact points of the second pressing member 32 and a base 4. Thus, a holding state of the first pressing member 31 and the second pressing member 32 is further stabilized.

Note that the present embodiment is different from the first embodiment in that the first pressing member 31 is not provided with a projection 315 and that the holding member 2 does not have a recess 23*a*. Also in the present embodiment, the first pressing member 31 may be provided with the projection 315, and the holding member 2 may have the recess 23*a* in order to reduce positional displacement of the first pressing member 31 in the circumferential direction.

2.2 Operation

Figure 12:
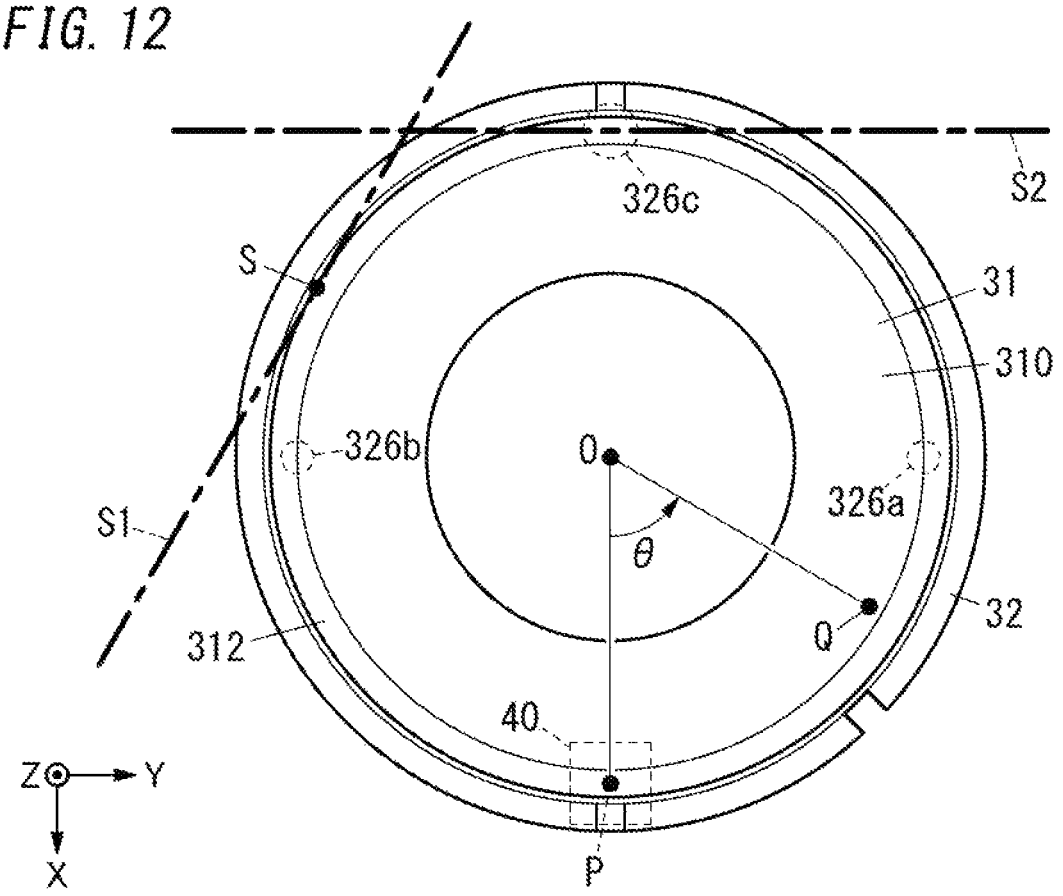
FIG. 12 is a view schematically illustrating operation of the press-type input device of the second embodiment.
Figure 13:
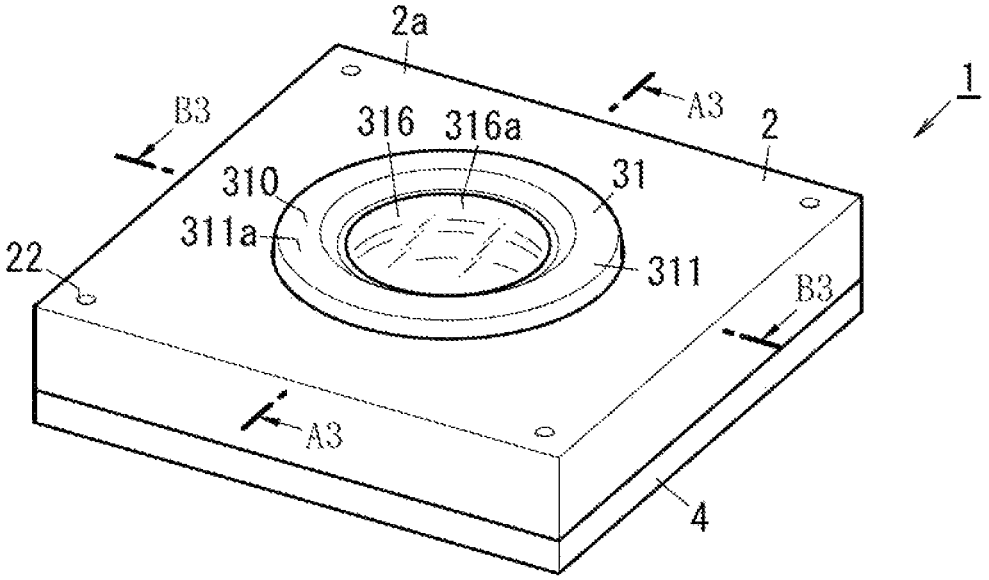
FIG. 13 is a perspective view illustrating a press-type input device of a third embodiment.

Next, operation of the press-type input device 1 will be described with reference to FIG. 12. FIG. 12 is a view schematically illustrating operation of the first pressing member 31 and the second pressing member 32 when the press-type input device 1 is viewed from the positive to negative direction of the Z-axis. In FIG. 12, a point O represents the center of the opening 20, a point P is the location of the detection unit 40 (in the present embodiment, the push switch), and a point Q is a location where the pressure receiving surface 310 is pushed (the location of a working point). A line segment OP is an initial line, a line segment OQ is a moving radius, and an angle anticlockwise formed between the line segment OP and the line segment OQ in an XY plane is denoted by θ.

When the point Q on the pressure receiving surface 310 of the first pressing member 31 is pushed, a point S which is on an outer perimeter of the flange 312 and which is at a location symmetrical to the point Q about the point O is a contact point to the first bottom surface 201*b* of the holding member 2. A first axis S1 which extends through the point S and which is vertical to a line segment SQ appears, and the first pressing member 31 tilts around the first axis S1. The location of the first axis S1 is variable depending on an arbitrary angle θ. As the first pressing member 31 tilts, the two bosses 326*a* and 326*b* move in the negative direction of the Z-axis. Then, a second axis S2 which extends through a boss 326*c* and which is parallel to a straight line connecting apexes of the bosses 326*a* and 326*b* appears, and the second pressing member 32 tilts around the second axis S2. As a result, the second pressing member 32 pushes the detection unit 40, and the detection unit 40 detects the tilt of the second pressing member 32.

As to the second pressing member 32, the bosses 326*a* and 326*b* are equidistant from a straight line connecting the apex of the boss 326*c* to the point P. Each of the distances from the second axis S2 to the bosses 326*a* and 326*b* is half of the distance from the second axis S2 to the point P. Therefore, a pushing load at the point Q is equally divided between the bosses 326*a* and 326*b*, and additionally, a pushing load at the bosses 326*a* and 326*b* is equal to a pushing load at the point P. Moreover, the sum of travel distances of the bosses 326*a* and 326*b* is equal to the travel distance of the point P.

As to the first pressing member 31, the bosses 326*a* and 326*b* are equidistant from a straight line connecting the point Q to the point S. When the point Q is located near the outer perimeter of the pressure receiving surface 310 and the distance from the point O to each of the bosses 326*a* and 326*b* is substantially equal to the line segment OQ, the distance from the first axis S1 to the boss 326*a* is OQ(1+sinθ), and the distance from the first axis S1 to the boss 326*b* is OQ(1−sinθ). When the pushing load at the point P is denoted by Fsw, and the pushing load at the point Q is denoted by F, it can be seen from the following formula (1) of a balance around the first axis S1 that the pushing load Fsw at the point P is equal to the pushing load F at the point Q.

[Formula 1]

$$2OQ\times F=OQ(1+\sin\theta)F_{sw}+OQ(1-\sin\theta)F_{sw} \quad (1)$$

Similarly, when the stroke at the point P is denoted by Tsw, and the stroke at the point Q is denoted by T, it can be seen from the following formula (2) that the stroke Tsw at the point P is equal to the stroke T at the point Q.

[Formula 2]

$$T_{sw}=\{OQ(1+\sin\theta)/(2OQ\}T+\{OQ(1-\sin\theta)/(2OQ)\}T \quad (2)$$

According to the press-type input device 1 of the present embodiment, pushing force is detectable by the detection unit 40 no matter where on the pressure receiving surface 310 the pushing force is exerted. In particular, when the point Q is located near the outer perimeter of the pressure receiving surface 310, a push operation (the pushing load and the stroke) given to the pressure receiving surface 310 can be, substantially as it is, transmitted as a push operation (the pushing load and the stroke) given to the detection unit 40 no matter where to the entire perimeter of the pressure receiving surface 310 the push operation is given.

3. Third Embodiment

3.1 Configuration

FIGS. 13 to 16 show a press-type input device 1 according to the present embodiment. Note that components similar to those in the press-type input device 1 of the first embodiment are denoted by the same reference signs, and the description thereof will be omitted.

Mainly, in the present embodiment, the configurations of a first pressing member 31 and a second pressing member 32 are respectively different from the configurations of the first pressing member 31 and the second pressing member 32 in the press-type input device 1 according to the first embodiment.

Specifically, the present embodiment includes a transparent member 316 which is circular and which is provided parallel to a Z-axis at the center of a body part 311 of the first pressing member 31. The first pressing member 31 is an annular member surrounding the transparent member 316. The transparent member 316 has a first surface 316*a* and a second surface 316*b*. The first surface 316*a* is a flat surface and is in a positive direction of the Z-axis. The second surface 316*b* is a convex spherical surface and is in a negative direction of the Z-axis. The first surface 316*a* and the second surface 316*b* are respectively front and rear surfaces of the transparent member 316.

The body part 311 of the first pressing member 31 has a first surface 311*a* surrounding the first surface 316*a* of the transparent member 316. The first surface 311*a* of the body part 311 protrudes in the positive direction of the Z-axis beyond the first surface 316*a* of the transparent member 316. The first surface 311*a* of the body part 311 and the first surface 316*a* of the transparent member 316 form a pressure receiving surface 310.

Figure 14:
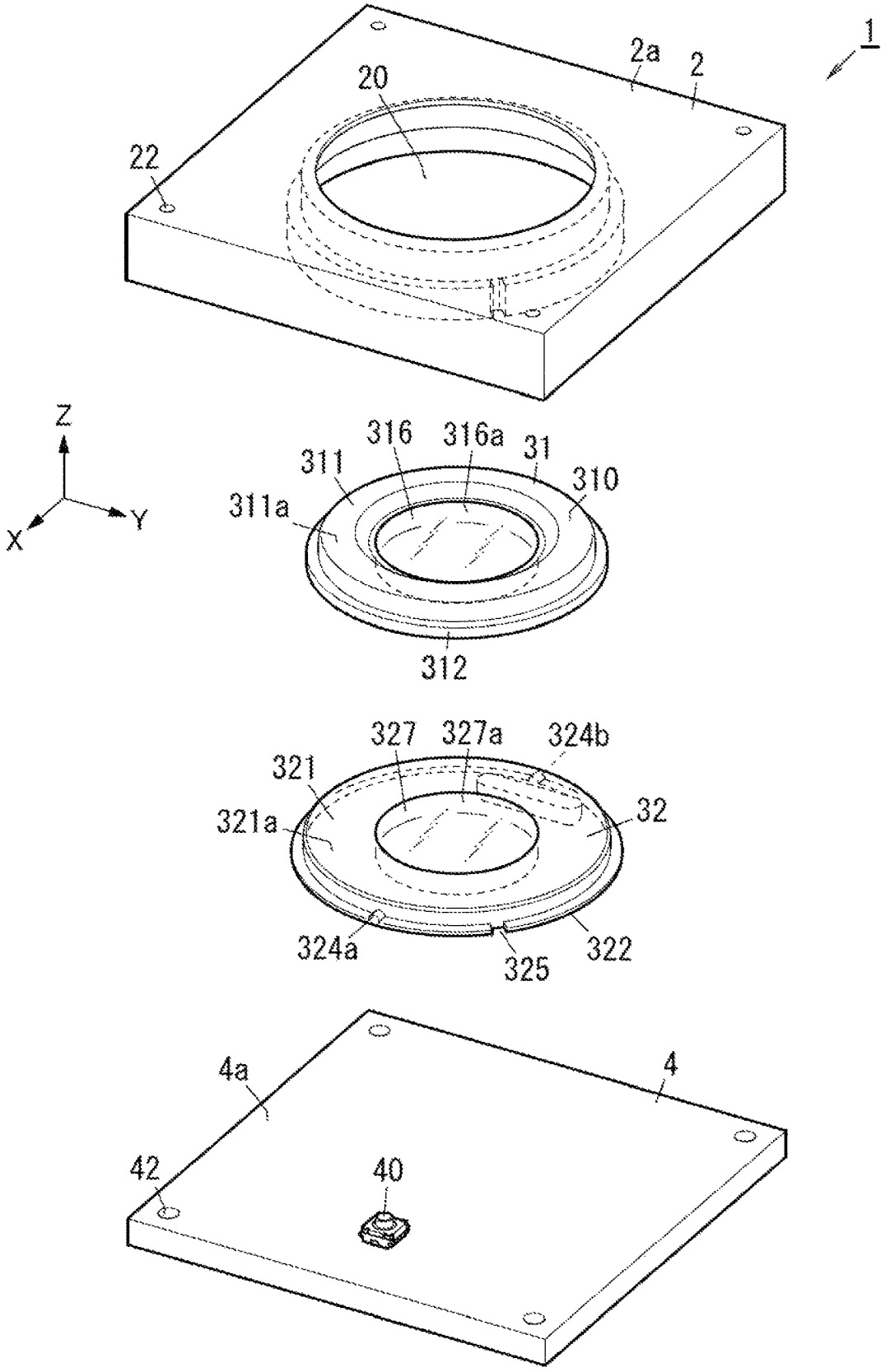
FIG. 14 is an exploded perspective view illustrating the press-type input device viewed from above of the third embodiment.

As illustrated in FIG. 14, the present embodiment is different from the first embodiment in that the first pressing member 31 is not provided with four ribs 314*a* to 314*d*. Therefore, in a state where the pressure receiving surface 310 is not pushed, a flange 312 of the first pressing member 31 is in contact with a first bottom surface 201*b* of a holding member 2. That is, along a direction (a Z-axis direction) vertical to the pressure receiving surface 310, the first pressing member 31, which has a circular, elliptical, or rectangular (in the present embodiment, a circular) shape in the form of a ring, is in contact with the holding member 2. The center of the circular, elliptical, or rectangular shape (the intersection of diagonal lines in the case of the rectangular shape) is one contact point of the first pressing member 31 and the second pressing member 32. This stabilizes a holding state of the first pressing member 31 and the second pressing member 32.

The present embodiment includes a transparent member 327 which is circular and which is provided parallel to the Z-axis at the center of a body part 321 of the second pressing member 32. The second pressing member 32 is an annular member surrounding the transparent member 327. The transparent member 327 has a first surface 327*a* and a second surface 327*b*. The first surface 327*a* is in the positive direction of the Z-axis. The second surface 327*b* is in the negative direction of the Z-axis. The first surface 327*a* and the second surface 327*b* are flat surfaces, are parallel to each other, and are respectively front and rear surfaces of the transparent member 327.

As illustrated in FIG. 14, the present embodiment is different from the first embodiment in that a first surface 321*a* of the body part 321 of the second pressing member 32 is not provided with two bosses 326*a* and 326*b*. The first surface 321*a* of the body part 321 of the second pressing member 32 is flush with the first surface 327*a* of the transparent member 327.

Figure 16A:
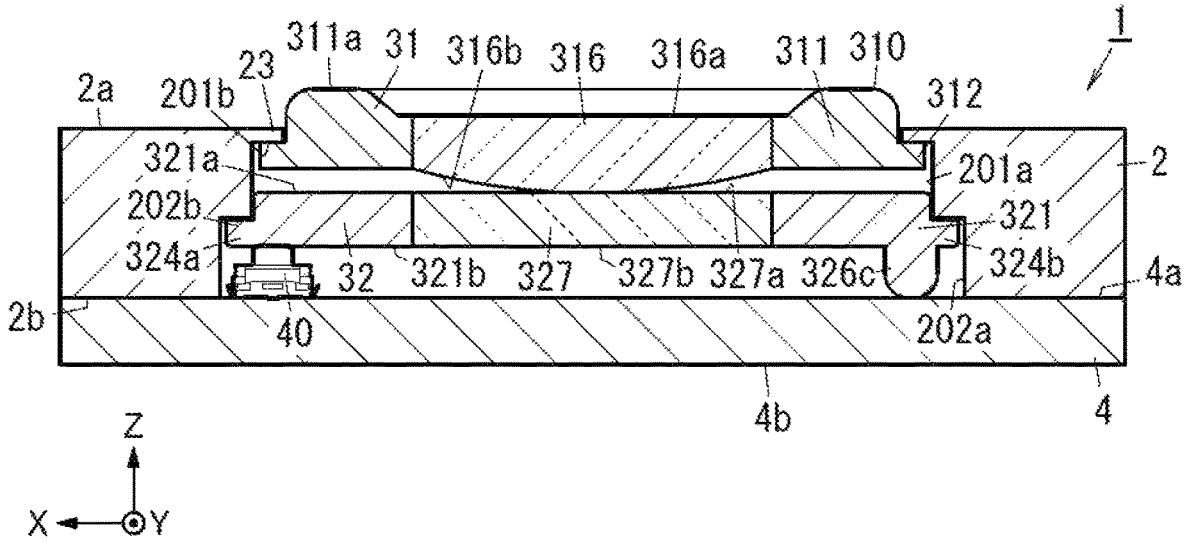
FIG. 16A is a sectional view taken along line A3-A3 of FIG. 13.
Figure 16B:
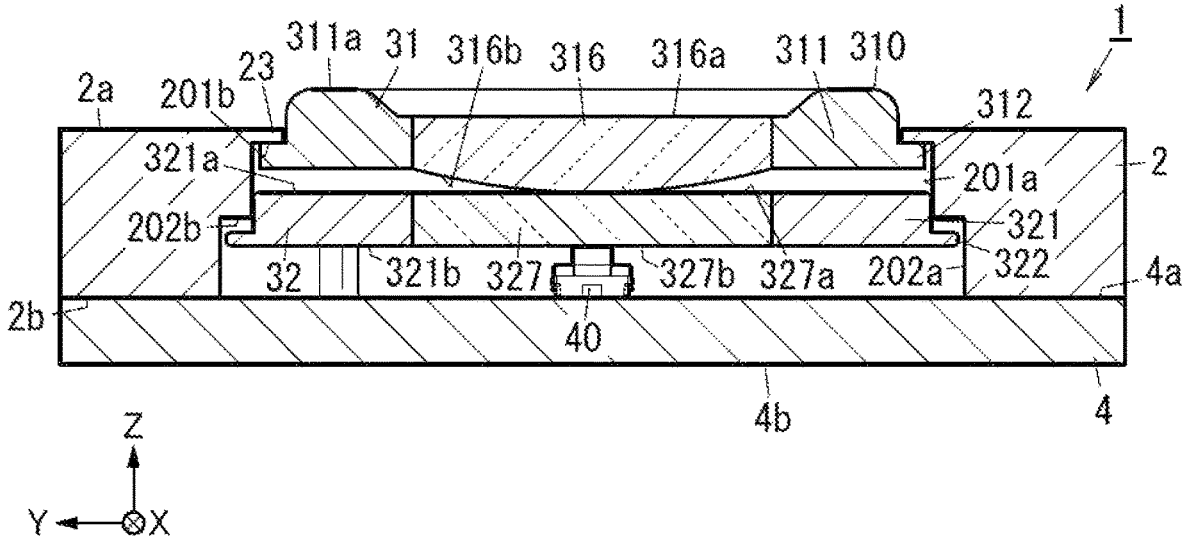
FIG. 16B is a sectional view taken along line B3-B3 of FIG. 13.

As illustrated in FIGS. 16A and 16B, in the present embodiment, the second surface 316*b*, which is a convex spherical surface, of the transparent member 316 of the first pressing member 31 is in point contact with the first surface 327*a*, which is a flat surface, of the transparent member 327 of the second pressing member 32. Note that the second surface 316*b* of the transparent member 316 may have a center portion provided with a projection and a portion which is other than the center portion and which is a flat surface, although the figure of this configuration is omitted. In this case, the projection of the second surface 316*b* of the transparent member 316 is in point contact with the first surface 327*a*, which is the flat surface, of the transparent member 327.

Figure 15:
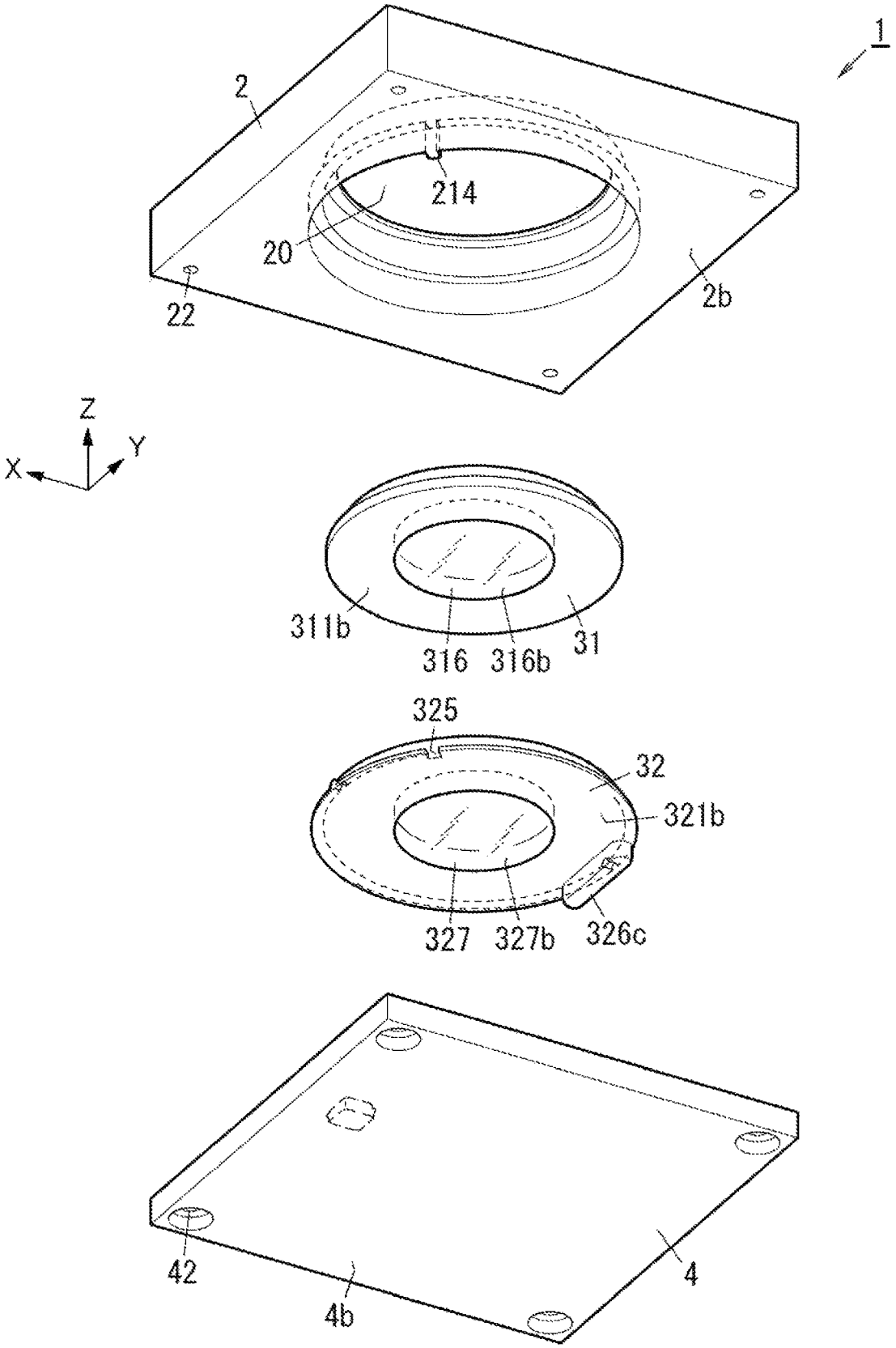
FIG. 15 is an exploded perspective view illustrating the press-type input device of the third embodiment viewed from below.

As illustrated in FIG. 15, the second pressing member 32 of the present embodiment has a boss 326*c* elongated parallel to a Y-axis. The length of the boss 326*c* is longer than the radius and shorter than the diameter of the outer peripheral circle of the transparent member 327. As illustrated in FIG. 16A, the boss 326*c* of the second pressing member 32 is in line contact with a first surface 4*a* of a base 4.

When the press-type input device 1 is viewed from the positive to negative direction of the Z-axis, the first surface 4*a* of the base 4 is viewed through the transparent member 316 and the transparent member 327. At least viewed part of the base 4 may be transparent. In this case, a detection unit 40 is not viewed through the transparent member 316 and the transparent member 327 (see FIG. 16A).

In the present embodiment, along the direction (the Z-axis direction) vertical to the pressure receiving surface 310, the second pressing member 32 and the base 4 are in contact with each other at two points one of which is the detection unit 40. The other point is the boss 326*c*. The first pressing member 31 and the second pressing member 32 are in contact with each other at one point (see FIGS. 16A and 16B). The one contact point (a point O in FIG. 17 which will be described later) of the first pressing member 31 and the second pressing member 32 is located on a line segment connecting two contact points (one contact point is a point P and the other contact point is the midpoint of the boss 326*c* in the Y-axis direction in FIG. 17 which will be described later) of the second pressing member 32 and the base 4. This stabilizes a holding state of the first pressing member 31 and the second pressing member 32.

Note that the present embodiment is different from the first embodiment in that the first pressing member 31 is not provided with a projection 315 and that the holding member 2 does not have a recess 23*a*. Also in the present embodiment, the first pressing member 31 may be provided with the projection 315, and the holding member 2 may have the recess 23*a* in order to reduce positional displacement of the first pressing member 31 in the circumferential direction.

3.2 Operation

Figure 17:
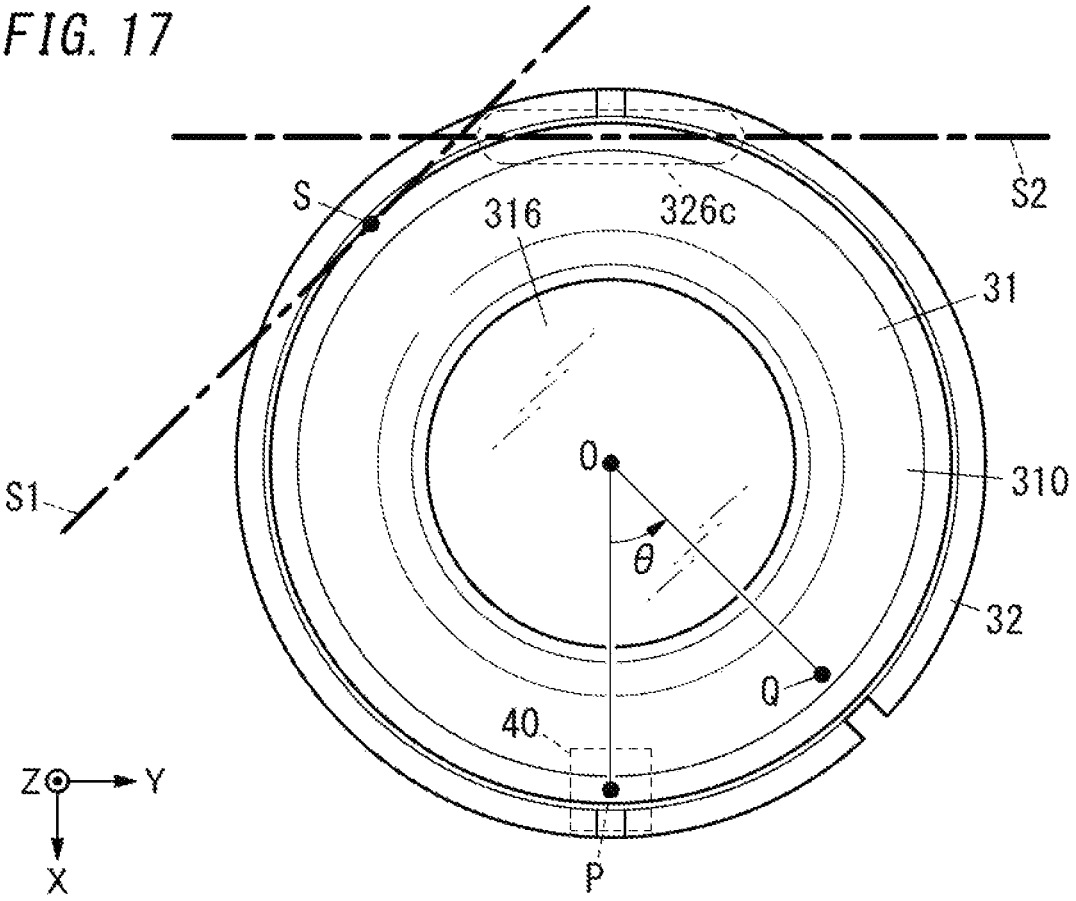
FIG. 17 is a view schematically illustrating operation of the press-type input device of the third embodiment.
Figure 18:
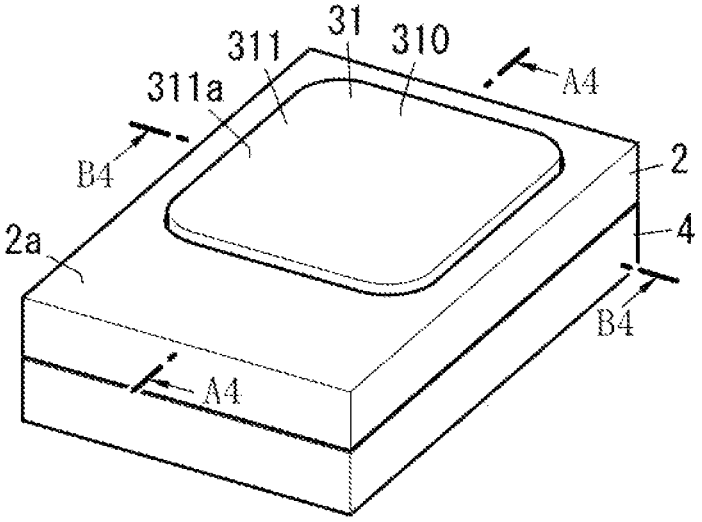
FIG. 18 is a perspective view illustrating a press-type input device of a fourth embodiment.

Next, operation of the press-type input device 1 will be described with reference to FIG. 17. FIG. 17 is a view schematically illustrating operation of the first pressing member 31 and the second pressing member 32 when the press-type input device 1 is viewed from the positive to negative direction of the Z-axis. In FIG. 17, the point O represents the center of the transparent member 316, the point P is the location of the detection unit 40 (in the present embodiment, a push switch), and a point Q is a location where the pressure receiving surface 310 is pushed (the location of a working point). A line segment OP is an initial line, a line segment OQ is a moving radius, and an angle anticlockwise formed between the line segment OP and the line segment OQ in an XY plane is denoted by θ.

When the point Q on the first surface 311*a*, which is the pressure receiving surface 310, of the body part 311 of the first pressing member 31 is pushed, a point S which is on an outer perimeter of the flange 312 and which is at a location symmetrical to the point Q about the point O is a contact point to the first bottom surface 201*b* of the holding member 2. A first axis S1 which extends through the point S and which is vertical to a line segment SQ appears, and the first pressing member 31 tilts around the first axis S1. The location of the first axis S1 is variable depending on an arbitrary angle θ. As the first pressing member 31 tilts, a contact point of the second surface 316*b*, which is the convex spherical surface, of the transparent member 316 of the first pressing member 31 and the first surface 327*a*, which is the flat surface, of the transparent member 327 of the second pressing member 32 also moves in the negative direction of the Z-axis. Then, a second axis S2 which extends through the boss 326*c* and which is parallel to the Y-axis appears, and the second pressing member 32 tilts around the second axis S2. As a result, the second pressing member 32 pushes the detection unit 40, and the detection unit 40 detects the tilt of the second pressing member 32.

When the point Q is located near the outer perimeter of the pressure receiving surface 310, the contact point (in the present embodiment, the point O) of the first pressing member 31 and the second pressing member 32 is the midpoint of the distance from the first axis S1 to the point Q and is the midpoint of the distance from the second axis S2 to the point P. Thus, a pushing load and a stroke at the point Q is substantially the same as a pushing load and a stroke at the detection unit 40.

When the center (in the present embodiment, the point O) of the first surface 316*a*, which is the pressure receiving surface 310 of the first pressing member 31, of the transparent member 316 is pushed vertically to the pressure receiving surface 310, the first pressing member 31 does not tilt but moves in the negative direction of the Z-axis. When the contact point (in the present embodiment, the point O) of the first pressing member 31 and the second pressing member 32 pushes the second pressing member 32, the second axis S2 which extends through the boss 326*c* and which is parallel to the Y-axis appears, and the second pressing member 32 tilts around the second axis S2. As a result, the second pressing member 32 pushes the detection unit 40, and the detection unit 40 detects the tilt of the second pressing member 32.

According to the press-type input device 1 of the present embodiment, pushing force is detectable by the detection unit 40 no matter where on the pressure receiving surface 310 the pushing force is exerted. In particular, when the point Q is located near the outer perimeter of the pressure receiving surface 310, a push operation (the pushing load and the stroke) given to the pressure receiving surface 310 can be, substantially as it is, transmitted as a push operation (the pushing load and the stroke) given to the detection unit 40 no matter where to the entire perimeter of the pressure receiving surface 310 the push operation is given.

4. Fourth Embodiment

4.1 Configuration

FIGS. 18 to 21 show a press-type input device 1 according to the present embodiment. Note that components similar to those in the press-type input device 1 of the first embodiment are denoted by the same reference signs, and the description thereof will be omitted.

In the present embodiment, a first pressing member 31 is light transmissive. The first pressing member 31 is a rectangular member. More specifically, the first pressing member 31 has a body part 311 which is a member having a rectangular shape and having four round corners. The present embodiment is different from the first embodiment in that the body part 311 has no through hole 313.

Figure 19:
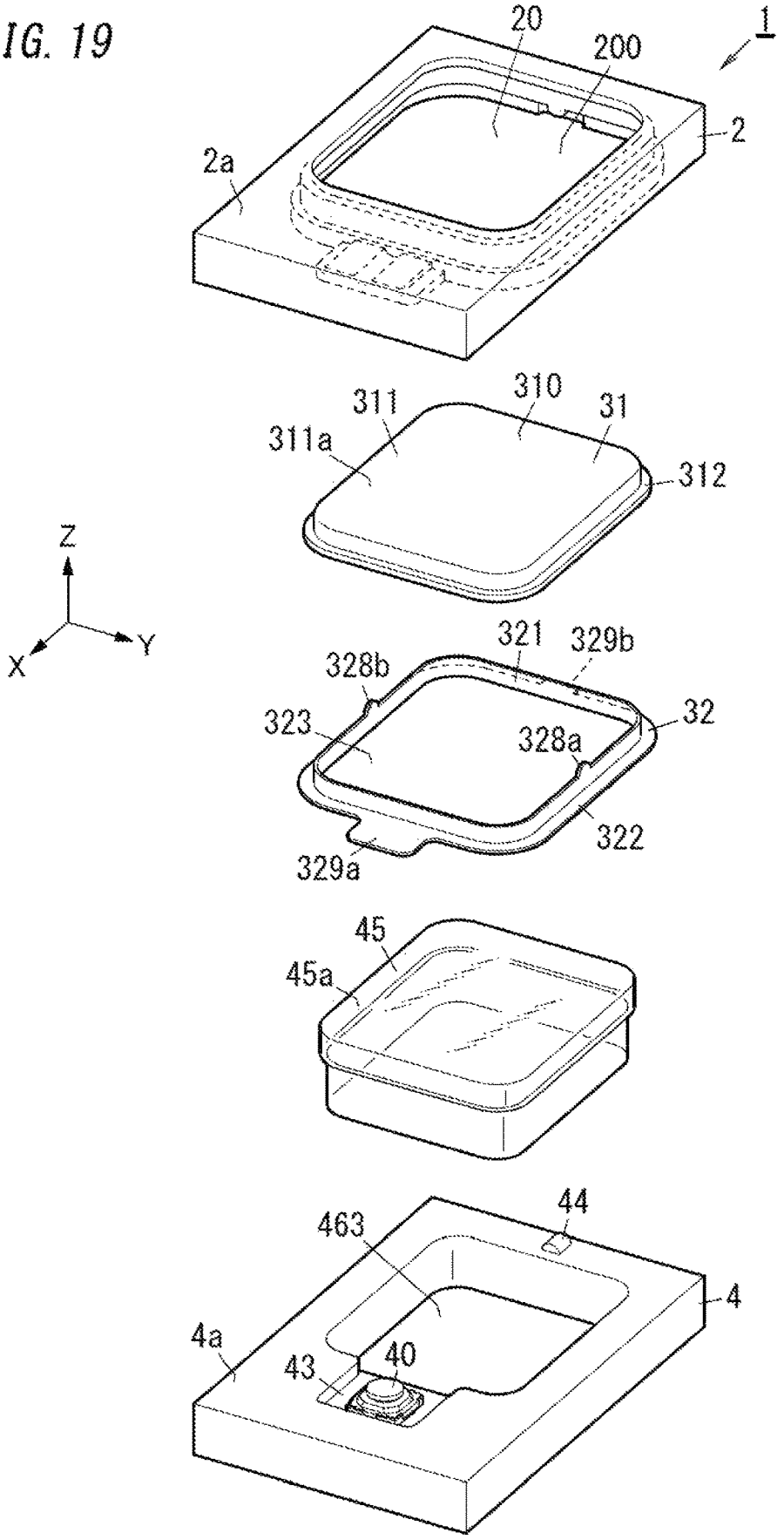
FIG. 19 is an exploded perspective view illustrating the press-type input device of the fourth embodiment viewed from above.

The first pressing member 31 includes a flange 312 protruding parallel to an XY plane from an outer peripheral surface of the body part 311. The flange 312 has a uniform width and a uniform thickness. As illustrated in FIG. 19, the present embodiment is different from the first embodiment in that the first pressing member 31 is not provided with four ribs 314*a* to 314*d*.

A second pressing member 32 is a rectangular frame-shaped member. More specifically, the second pressing member 32 has a body part 321 which is a member having a rectangular frame shape and having four round corners, and the body part 321 has two sides parallel to an X-axis and two sides parallel to a Y-axis.

The body part 321 has two projections 328*a* and 328*b* each provided at the center of a corresponding one of the two sides parallel to the X-axis. Each of the two projections 328*a* and 328*b* has a semi-circular disk shape and protrudes in the positive direction of a Z-axis. The two projections 328*a* and 328*b* are present at symmetrical locations on a straight line which is parallel to the Y-axis and which extends through the center of a through hole 323. The two projections 328*a* and 328*b* serve in a similar manner to the two bosses 326*a* and 326*b* of the second pressing member 32 in the first embodiment.

The body part 321 has an outer peripheral surface from which a flange 322 protrudes parallel to the XY plane. The flange 322 has a uniform width and a uniform thickness. The present embodiment further includes two protruding pieces 329*a* and 329*b*. The two protruding pieces 329*a* and 329*b* respectively protrude in the positive direction and the negative direction of the X-axis from the center of a corresponding one of two sides, which are parallel to the Y-axis, of the flange 322 of the body part 321. The present embodiment is different from the first embodiment in that the flange 322 has no recess 325.

In the present embodiment, a base 4 further has a through hole 463, a recess 43, and a boss 44. The through hole 463 has a rectangular shape having four round corners and is provided parallel to the Z-axis in the base 4. The recess 43 is provided in the base 4 so as to open in the positive direction of the Z-axis. The recess 43 adjoins the through hole 463 and is communicated with the through hole 463. The recess 43 has a bottom surface provided with a detection unit 40. The boss 44 is provided to a first surface 4*a* of the base 4. The boss 44 protrudes in the positive direction of the Z-axis. The detection unit 40 and the boss 44 are present at symmetrical locations on a straight line which is parallel to the X-axis and which extends through the center of the through hole 463. The boss 44 serves in a similar manner to the boss 326*c* of the second pressing member 32 in the first embodiment.

Figure 20:
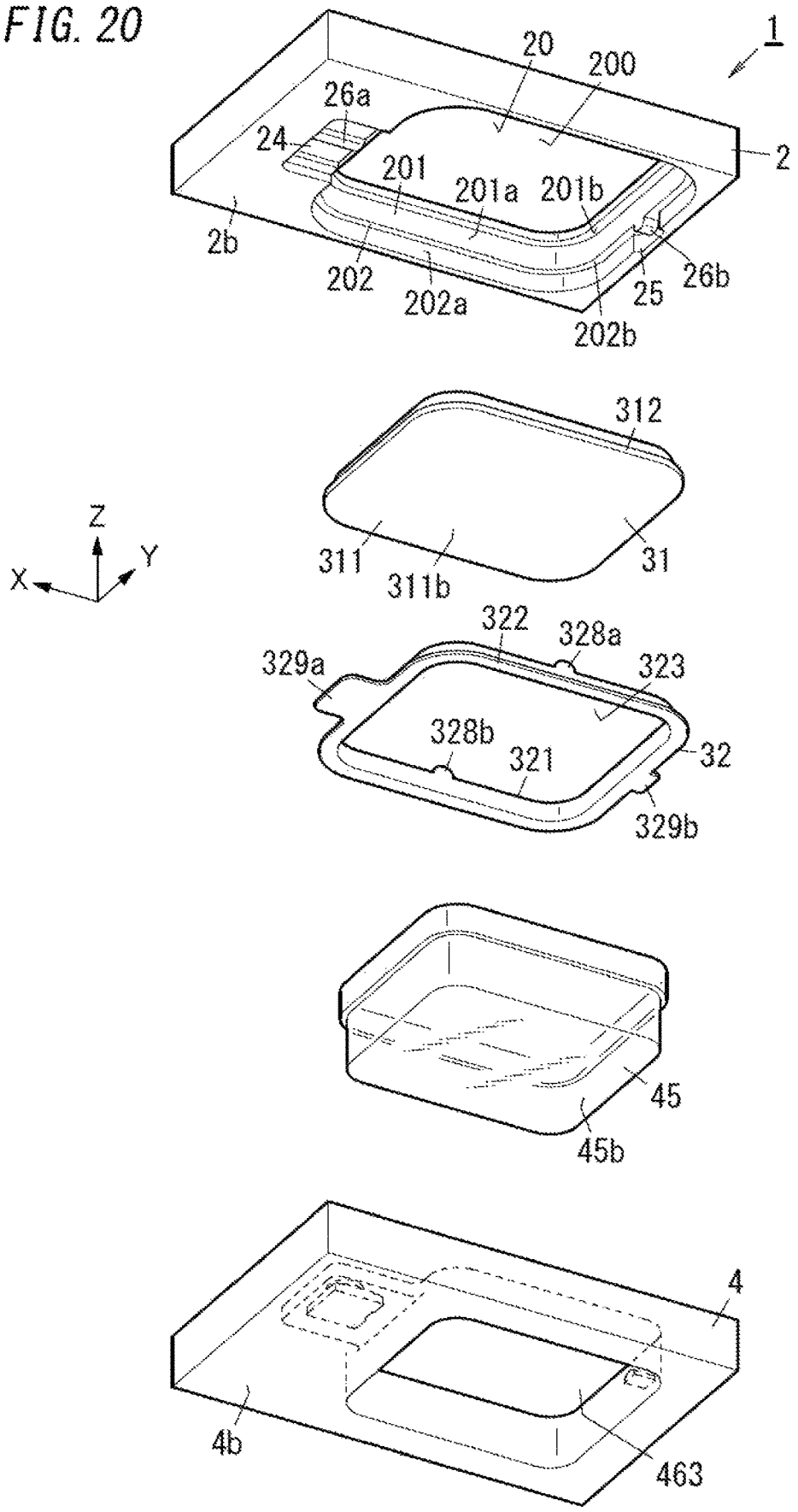
FIG. 20 is an exploded perspective view illustrating the press-type input device of the fourth embodiment viewed from below.

In the present embodiment, as illustrated in FIG. 20, a holding member 2 further has two recesses 24 and 25 and two ribs 26*a* and 26*b*.

The recess 24 is a space in which the protruding piece 329*a* of the second pressing member 32 is to be accommodated. The recess 24 is provided in the holding member 2 so as to open in the negative direction of the Z-axis. The recess 24 adjoins a housing section 200 and is communicated with the housing section 200. The recess 24 has a bottom surface provided with the rib 26*a*. The rib 26*a* protrudes in the negative direction of the Z-axis.

The recess 25 is a space in which the protruding piece 329*b* of the second pressing member 32 is to be accommodated. The recess 25 is provided in the holding member 2 so as to open in the negative direction of the Z-axis. The recess 25 adjoins the housing section 200 and is communicated with the housing section 200. The recess 25 has a bottom surface provided with the rib 26*b*. The rib 26*b* protrudes in the negative direction of the Z-axis. The ribs 26*a* and 26*b* serve in a similar manner to the rib 324*a* and the rib 324*b* of the second pressing member 32 in the first embodiment.

The two ribs 26*a* and 26*b* face each other in a direction parallel to the X-axis.

Figure 21A:
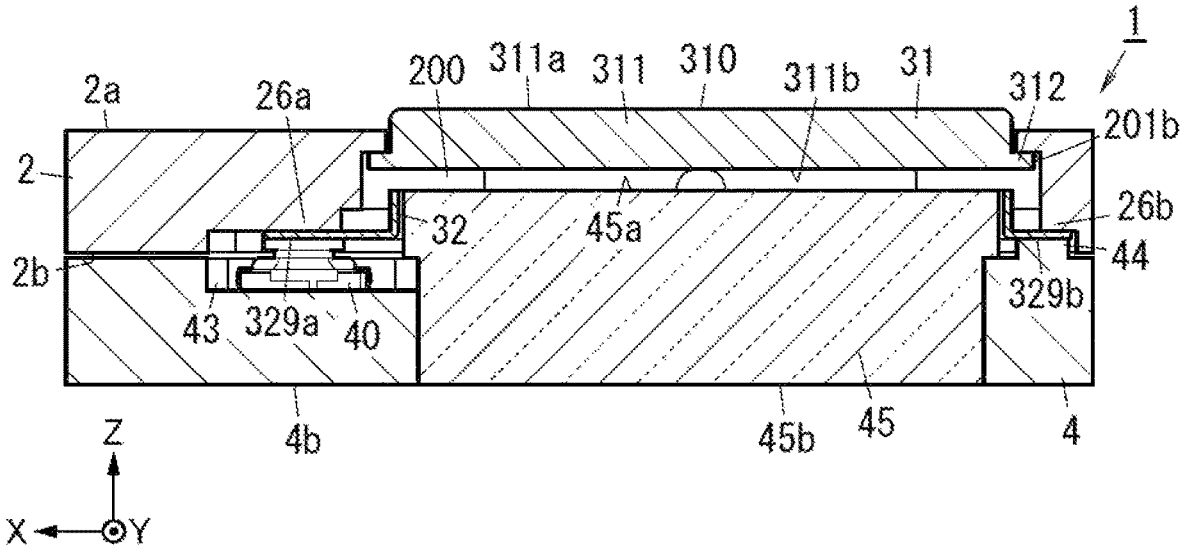
FIG. 21A is a sectional view taken along line A4-A4 of FIG. 18.
Figure 21B:
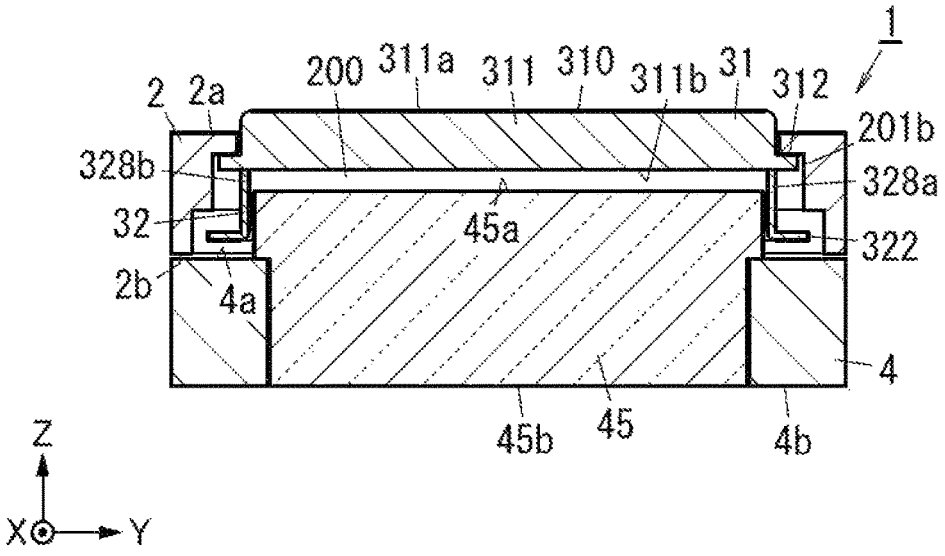
FIG. 21B is a sectional view taken along line B4-B4 of FIG. 18.

In the present embodiment, the press-type input device 1 further includes a light transmitting member 45. The light transmitting member 45 is a rectangular parallelepiped member and is made of, for example, ulexite. The light transmitting member 45 has a first surface 45*a* and a second surface 45*b*. The first surface 45*a* is a flat surface and is in a positive direction of the Z-axis. The second surface 45*b* is a flat surface and is in the negative direction of the Z-axis. The first surface 45*a* and the second surface 45*b* are parallel to each other and are respectively front and rear surfaces of the light transmitting member 45. The first surface 45*a* and the second surface 45*b* are rectangular surfaces having four round corners when viewed along a Z-axis direction. The first surface 45*a* is slightly larger than the through hole 463 formed in the base 4. The second surface 45*b* has the same size as the through hole 463 formed in the base 4. The thickness of the light transmitting member 45 is greater than the thickness of the base 4. As illustrated in FIGS. 21A and 21B, the second surface 45*b* of the light transmitting member 45 is flush with a second surface 4*b* of the base 4. The first surface 45*a* of the light transmitting member 45 protrudes in the positive direction of the Z-axis beyond the first surface 4*a* of the base 4. The light transmitting member 45 is fixed to the base 4.

As illustrated in FIGS. 21A and 21B, in the press-type input device 1, the flange 312 of the first pressing member 31 is in contact with a first bottom surface 201*b* of the holding member 2. That is, along a direction (the Z-axis direction) vertical to the pressure receiving surface 310, the first pressing member 31, which has a rectangular shape in the form of a ring, is in contact with the holding member 2. The center (an intersection of diagonal lines) of the rectangular shape is a midpoint of two contact points of the first pressing member 31 and a second pressing member 32. The midpoint of the two contact points is a midpoint between the two projections 328*a* and 328*b*. Thus, a holding state of the first pressing member 31 and the second pressing member 32 is further stabilized.

Moreover, when viewed in the direction (the Z-axis direction) vertical to the pressure receiving surface 310, a contact surface (in the present embodiment, a substantially rectangular annular surface of the flange 312) of the first pressing member 31 and the holding member 2 overlaps the two contact points of the first pressing member 31 and the second pressing member 32 and two contact points of the second pressing member 32 and a base 4. Thus, a holding state of the first pressing member 31 and the second pressing member 32 is further stabilized.

As illustrated in FIG. 21B, the two projections 328*a* and 328*b* of the second pressing member 32 are in contact with a second surface 311*b* of the first pressing member 31. The second surface 311*b* of the first pressing member 31 and the first surface 45*a* of the light transmitting member 45 are not in contact with each other.

As illustrated in FIG. 21A, the protruding piece 329*a* of the second pressing member 32 is provided between the detection unit 40 and the rib 26*a* of the holding member 2. In this state, the protruding piece 329*a* does not push the detection unit 40, and therefore, the detection unit 40 does not detect the tilt of the second pressing member 32. The protruding piece 329*b* of the second pressing member 32 is provided between the boss 44 of the base 4 and the rib 26*b* of the holding member 2. As illustrated in FIG. 21B, the flange 322 (a portion where the projection pieces 329*a* and 329*b* are not provided) of the second pressing member 32 is not in contact with the first surface 4*a* of the base 4.

In the present embodiment, when viewed in the direction (the Z-axis direction) vertical to the pressure receiving surface 310, the first pressing member 31 and the second pressing member 32 are substantially rectangular. Along the direction (the Z-axis direction) vertical to the pressure receiving surface 310, two sides (two sides in the X-axis direction) facing each other of the substantially rectangular shape are vertical to a line segment (a line segment parallel to the Y-axis) connecting the two contact points of the first pressing member 31 and the second pressing member 32. The remaining two sides (two sides in the Y-axis direction) facing each other of the substantially rectangular shape are vertical to a line segment (a line segment parallel to the X-axis) connecting two contact points of the second pressing member 32 and the base 4. This stabilizes a holding state of the first pressing member 31 and the second pressing member 32.

4.2 Operation

Figure 22:
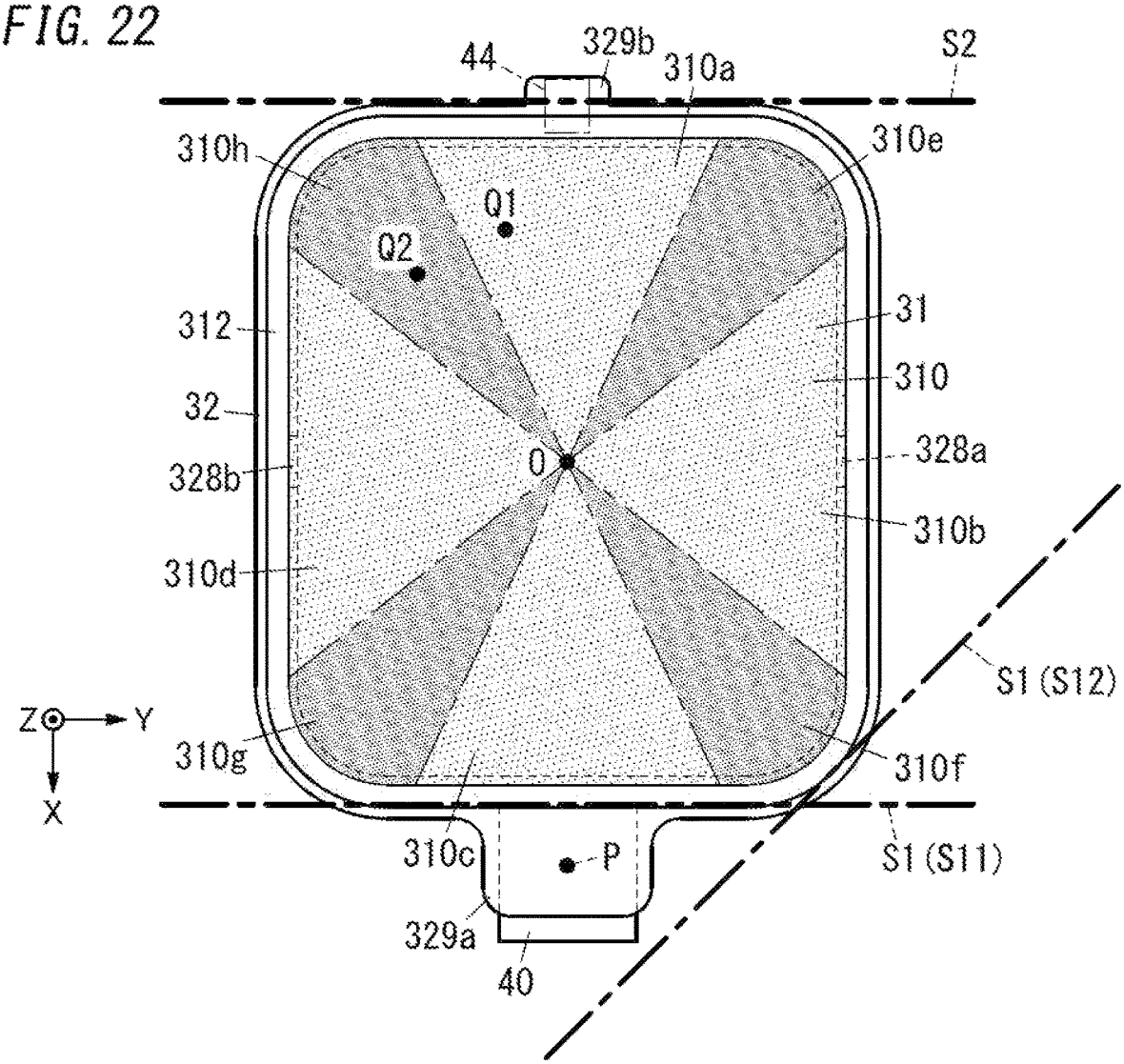
FIG. 22 is a view schematically illustrating operation of the press-type input device of the fourth embodiment.

Next, operation of the press-type input device 1 will be described with reference to FIG. 22. FIG. 22 is a view schematically illustrating operation of the first pressing member 31 and the second pressing member 32 when the press-type input device 1 is viewed from the positive to negative direction of the Z-axis.

Also the press-type input device 1 according to the present embodiment which adopts the configuration as described above operates in a similar manner to the press-type input device 1 according to the first and second embodiments in principle.

The press-type input device 1 according to the present embodiment is similar to the press-type input device 1 according to the second embodiment in that components corresponding to the four ribs 314*a* to 314*d* in the first embodiment are not provided.

The two projections 328*a* and 328*b* of the second pressing member 32 of the present embodiment serve in a similar manner to the two bosses 326*a* and 326*b* of the second pressing member 32 in the first embodiment. The ribs 26*a* and 26*b* of the holding member 2 of the present embodiment serve in a similar manner to the ribs 324*a* and 324*b* of the second pressing member 32 in the first embodiment. The boss 44 of the base 4 of the present embodiment serves in a similar manner to the boss 326*c* of the second pressing member 32 in the first embodiment.

As illustrated in FIG. 22, the pressure receiving surface 310 is divided into eight surfaces. Specifically, the pressure receiving surface 310 is divided into pressure receiving surfaces 310*a* to 310*h* by line segments connecting a point O at the middle of the two projections 328*a* and 328*b* of the second pressing member 32 to end points of four sides (straight line parts) of the flange 312 of the first pressing member 31.

The pressure receiving surfaces 310*a* to 310*d* are surfaces including the four sides (the straight line parts). The pressure receiving surfaces 310*e* to 310*h* are surfaces including round corner parts each located between the two sides (the straight line parts) adjacent to each other. In FIG. 22, shadings different between the pressure receiving surfaces 310*a* to 310*d* and the pressure receiving surfaces 310*e* to 310*h* are applied to distinguish the pressure receiving surfaces 310*a* to 310*d* from the pressure receiving surfaces 310*e* to 310*h*. A case where any one of the pressure receiving surfaces 310*a* to 310*d* is pushed and a case where any one of the pressure receiving surfaces 310*e* to 310*h* is pushed are separately described below.

When any one surface of the pressure receiving surfaces 310*a* to 310*d* is pushed, a side which is one of the sides (the straight line parts) of the outer perimeter of the flange 312 and which is at a location symmetrical to the one surface thus pushed about the point O serves as a first axis S1. The first pressing member 31 tilts around the first axis S1. In FIG. 22, a first axis S11 is shown which appears when a point Q1 on the pressure receiving surface 310*a* is pushed. Note that when the pressure receiving surfaces 310*a* to 310*d* are pushed, operation is similar to that in the case of θ being 0°, 90°, 180°, and 270° respectively in the first embodiment.

On the other hand, when any one pressure receiving surface of the pressure receiving surfaces 310*e* to 310*h* is pushed, a tangential line which is one of tangential lines to the round corners of the outer perimeter of the flange 312 and which is at a location symmetrical to the one pressure receiving surface thus pushed about the point O serves as a first axis S1. The first pressing member 31 tilts around the first axis S1. In FIG. 22, a first axis S12 is shown which appears when a point Q2 on the pressure receiving surface 310*h* is pushed. Note that when the pressure receiving surfaces 310*e* to 310*h* are pushed, operation is similar to that in the second embodiment.

According to the press-type input device 1 of the present embodiment, pushing force is detectable by the detection unit 40 no matter where on the pressure receiving surface 310 the pushing force is exerted.

5. Fifth Embodiment

5.1 Schema

Figure 23:
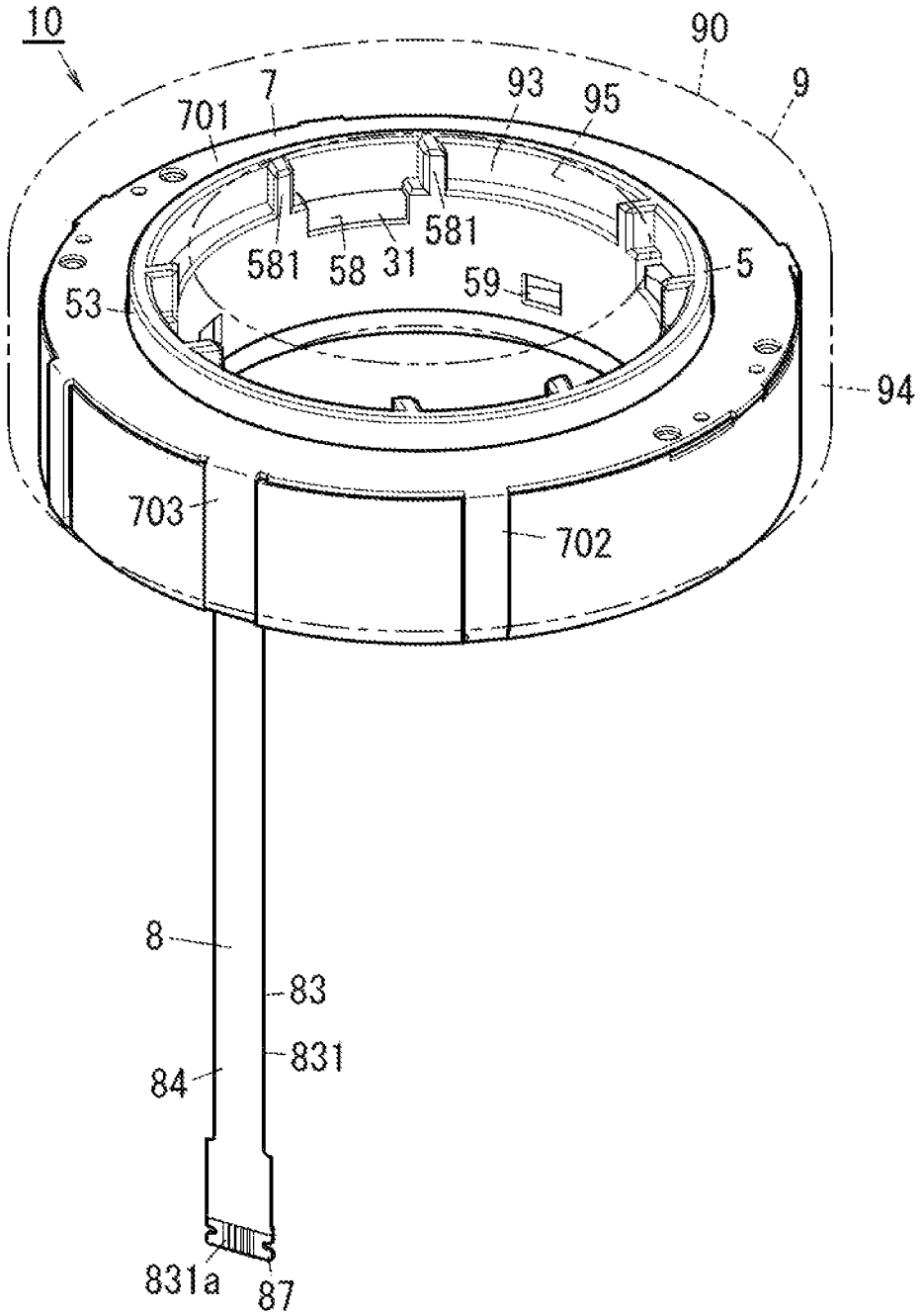
FIG. 23 is a perspective view illustrating a press-rotate-type input device of a fifth embodiment.
Figure 24:
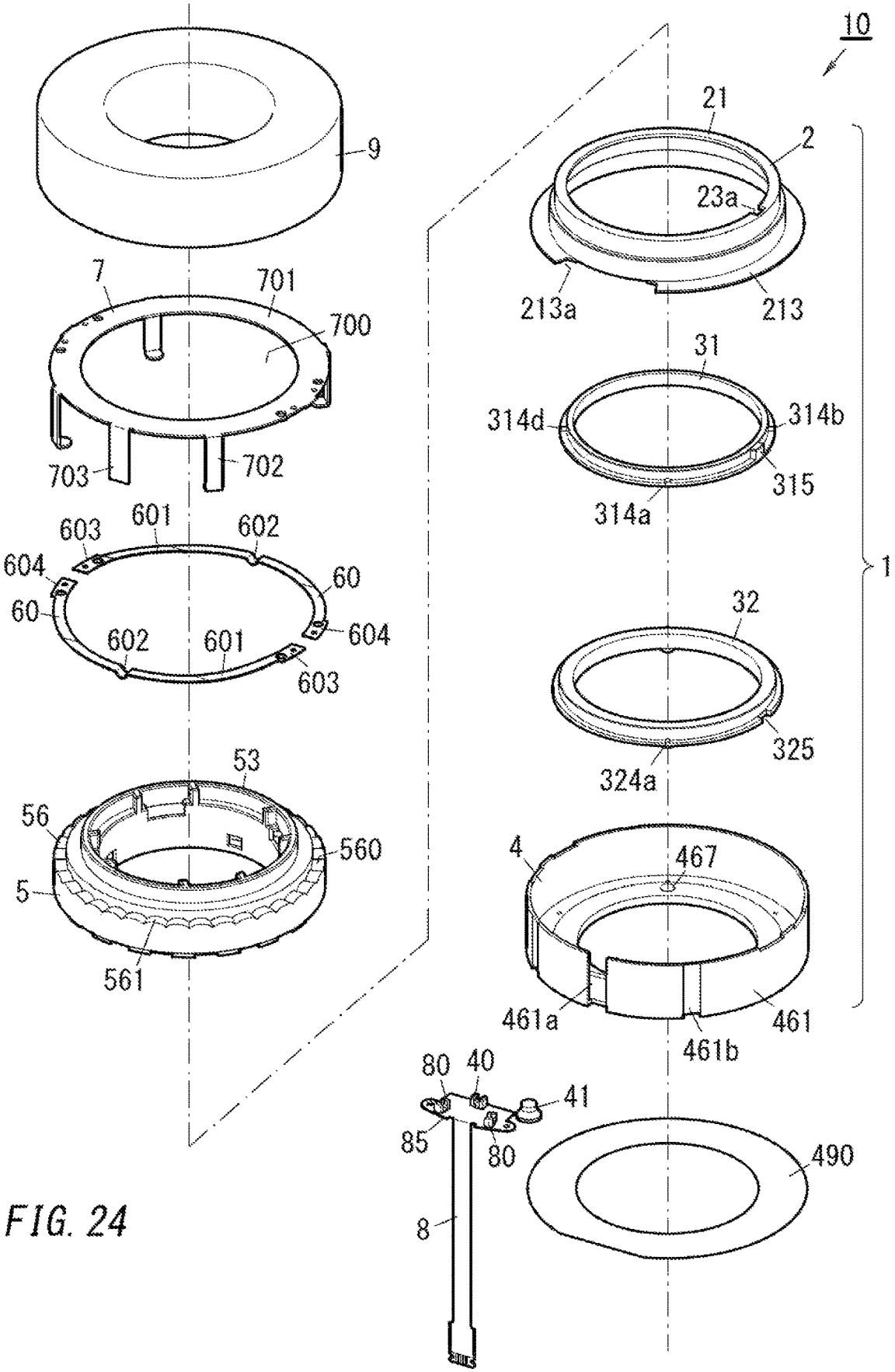
FIG. 24 is an exploded perspective view illustrating the press-rotate-type input device of the fifth embodiment.

The press-type input device 1 described above may be incorporated into a press-rotate-type input device 10. The press-rotate-type input device 10 is, for example, a rotary encoder. FIGS. 23 and 24 show the press-rotate-type input device 10 according to the present embodiment. The press-rotate-type input device 10 includes the press-type input device 1, a rotor 5, and a circuit block 8. The press-type input device 1 has a cylindrical part 21. The rotor 5 surrounds the cylindrical part 21. The rotor 5 is rotatable around the cylindrical part 21. The circuit block 8 is held by the base 4 of the press-type input device 1. The circuit block 8 is configured to detect the rotation amount of the rotor 5.

Since the press-rotate-type input device 10 includes the press-type input device 1, pushing force is detectable by the detection unit 40 no matter where on the pressure receiving surface 310 the pushing force is exerted. In addition, the rotation amount of the rotor 5 is also detectable.

5.2 Configuration

The press-rotate-type input device 10 will be described further in detail below with reference to FIGS. 23 to 28. Note that for convenience of explanation, an X-axis, a Y-axis, and a Z-axis orthogonal to one another are shown in part of each figure. The positive direction of the Z-axis is defined as an upward direction, the negative direction of the Z-axis is defined as a downward direction, but these directions are not intended to limit directions in which the press-rotate-type input device 10 is used. Components similar to those in the press-type input device 1 of the embodiments described above are denoted by the same reference signs, and the description thereof will be omitted.

As illustrated in FIGS. 23 and 24, the press-rotate-type input device 10 includes the press-type input device 1, the rotor 5, and the circuit block 8. The press-rotate-type input device 10 further includes spring members 60 and a fixing bracket 7. The press-rotate-type input device 10 may further include a knob 9. The press-rotate-type input device 10 is fixable to a touch panel (not shown) with, for example, a double-sided tape 490. For a user, intuitively grasping that the operation is valid is easier in a case where an operation is given via the press-rotate-type input device 10 than in a case where the user directly touches the touch panel to give the operation. When a through hole is provided at the center of the press-rotate-type input device 10 as illustrated in FIG. 23, a user can see information displayed on the touch panel or give an operation to the touch panel through the through hole. Note that electrical connection to the touch panel is achieved by accordingly drawing an extension section 831 of the circuit block 8 and connecting a terminal part 831*a* of the extension section 831 to a target circuit.

First, the press-type input device 1 in the press-rotate-type input device 10 will be described.

Figure 25A:
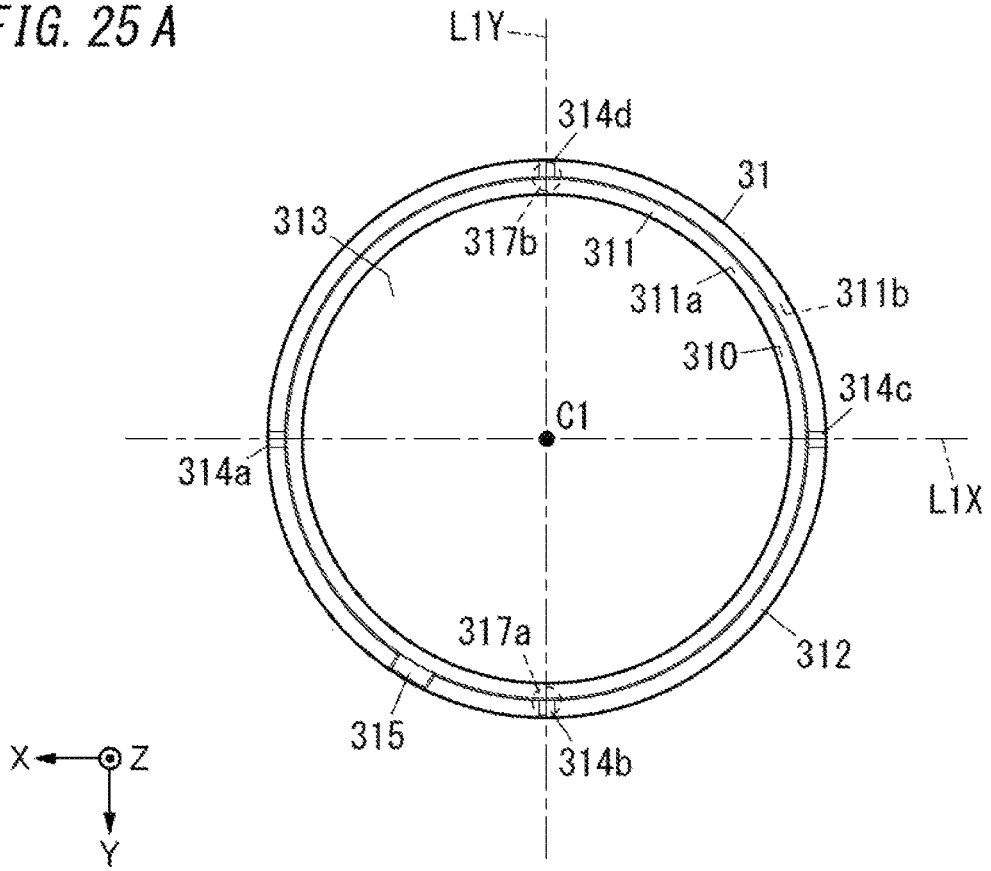
FIG. 25A is a plan view illustrating a first pressing member in the press-rotate-type input device of the fifth embodiment.

In the present embodiment, the second surface 311*b* of the body part 311 of the first pressing member 31 is provided with two bosses 317*a* and 317*b* as illustrated in FIG. 25. The two bosses 317*a* and 317*b* may form supporting points when the first pressing member 31 and the second pressing member 32 tilt. The two bosses 317*a* and 317*b* each has a tip end which is hemispherical. The two bosses 317*a* and 317*b* each protrudes in the negative direction of the Z-axis. The two bosses 317*a* and 317*b* are present at symmetrical locations on a straight line L1Y which is parallel to the Y-axis and which extends through the center C1 of the through hole 313. The two bosses 317*a* and 317*b* serve in a similar manner to the two bosses 326*a* and 326*b* of the second pressing member 32 in the first embodiment.

Figure 25B:
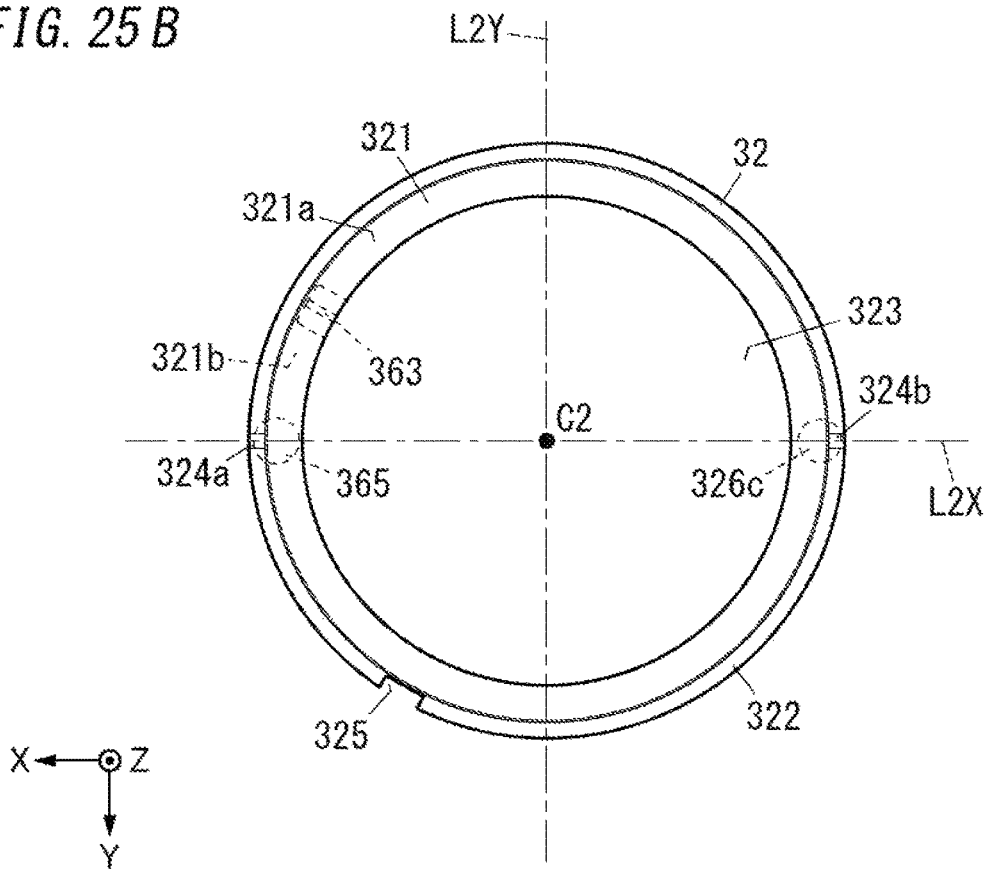
FIG. 25B is a plan view illustrating a second pressing member in the press-rotate-type input device of the fifth embodiment.

As illustrated in FIG. 25B, the present embodiment is different from the first embodiment (FIG. 4B) in that the second pressing member 32 is not provided with two bosses 326*a* and 326*b*. In place of the bosses 326*a* and 326*b*, the two bosses 317*a* and 317*b* are provided to the first pressing member 31 as described above.

In the present embodiment, the second surface 321*b* of the body part 321 of the second pressing member 32 is provided with a pressing section 365 as illustrated in FIG. 25B. The pressing section 365 is a section that pushes a dome 41 (see FIGS. 26B, 29A, and 29B) provided to the base 4 when the second pressing member 32 tilts. The pressing section 365 and the boss 326*c* are present at symmetrical locations on a straight line L2X which is parallel to the X-axis and which extends through the center C2 of the through hole 323.

As illustrated in FIG. 25B, the present embodiment further includes a shielding plate 363 provided to the second surface 321*b* of the body part 321 of the second pressing member 32. The shielding plate 363 is a plate inserted in a slit 40*a* of the detection unit 40 (see FIG. 26B, in the present embodiment, a photoelectric sensor) provided to the base 4 when the second pressing member 32 tilts, and thereby, the shielding plate 363 shields light between light receiving and emitting parts.

Figure 26A:
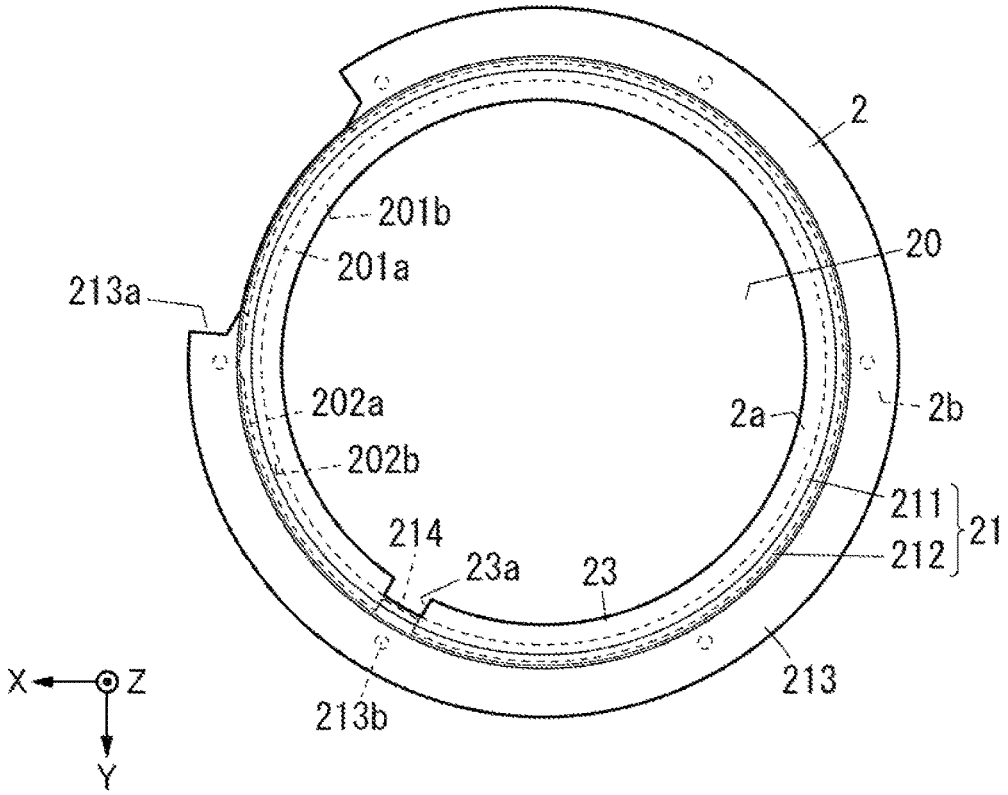
FIG. 26A is a plan view illustrating a holding member in the press-rotate-type input device of the fifth embodiment.

In the present embodiment, the holding member 2 is an annular member as illustrated in FIG. 26A. The holding member 2 includes the cylindrical part 21 and the flange 213.

The cylindrical part 21 includes a first cylindrical part 211 and a second cylindrical part 212. The inner diameter and the outer diameter of the second cylindrical part 212 is larger than those of the first cylindrical part 211. The first cylindrical part 211 and the second cylindrical part 212 are directly connected to each other and is provided with a difference in height at the border therebetween. The first cylindrical part 211 has a tip end at which the inner flange 23 protrudes radially inward. The opening 20 is surrounded by a tip end of the inner flange 23. The inner flange 23 has a surface which is in the positive direction of the Z-axis and which is the first surface 2*a*.

The flange 213 protrudes radially outward at a tip end of the second cylindrical part 212. The flange 213 has a surface which is in the negative direction of the Z-axis and which is the second surface 2*b*. The second surface 2*b* has a plurality of bosses 213*b*. The bosses 213*b* are used to fix the holding member 2 to the base 4. Part of the flange 213 is cut out to provide a cutout 213*a*. The cutout 213*a* has a shape along the outer shape of a body part 830 of the circuit block 8.

Figure 26B:
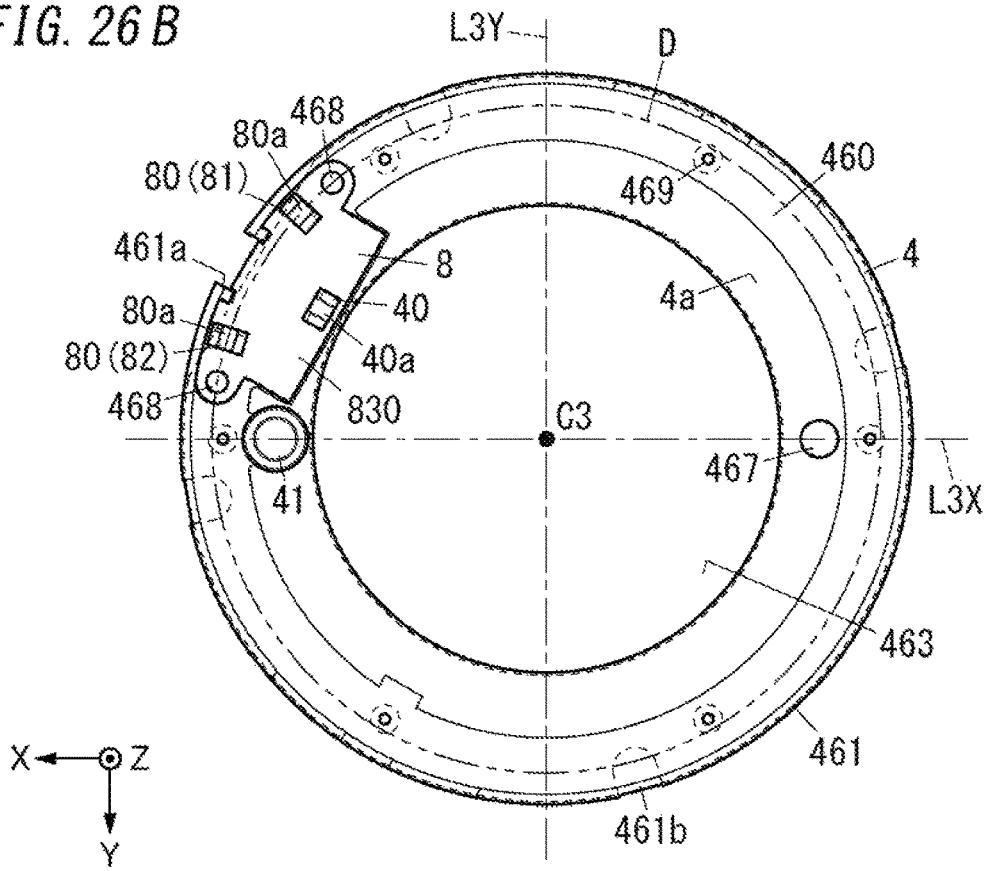
FIG. 26B is a plan view illustrating a base in the press-rotate-type input device of the fifth embodiment.

In the present embodiment, the base 4 is an annular member as illustrated in FIG. 26B. More specifically, the base 4 has a body part 460 which is annular and an outer wall 461. At the center of the body part 460, a through hole 463 which is circular is provided parallel to a Z-axis. In addition, the body part 460 has through holes 469 formed at locations facing the bosses 213*b* of the holding member 2. The bosses 213*b* are inserted into the through holes 469 to fix the holding member 2 to the base 4 by heat caulking and the like.

The body part 460 has a first surface 460*a* and a second surface 460*b*. The first surface 460*a* is in the positive direction of the Z-axis. The second surface 460*b* is in the negative direction of the Z-axis. The first surface 460*a* and the second surface 460*b* are respectively front and rear surfaces of the body part 460. The first surface 460*a* and the second surface 460*b* are annular band-like surfaces when viewed along a Z-axis direction.

The outer wall 461 protrudes from an outer peripheral edge of the body part 460 in the positive direction of the Z-axis. The outer wall 461 has an opening 461*a*. Part of the circuit block 8 provided on an inner side of the base 4 is pulled out of the base 4 through the opening 461*a*. The opening 461*a* is closed with a closing piece 703 of the fixing bracket 7 (see FIG. 23). The outer wall 461 has a plurality of (in the present embodiment, four) grooves 461*b*. The grooves 461*b* are provided in the Z-axis direction in the outer surface of the outer wall 461. Connection pieces 702 of the fixing bracket 7 are fit in the grooves 461*b* (see FIG. 23).

The base 4 includes the detection unit 40. The detection unit 40 detects the tilt of the second pressing member 32. The detection unit 40 is a photoelectric sensor. More specifically, the detection unit 40 includes a light-emitting unit a light-receiving unit which face each other with the slit 40*a* provided therebetween. The shielding plate 363 of the second pressing member 32 is inserted into the slit 40*a* and shields light from the light-emitting unit to the light-receiving unit, and thereby, the detection unit 40 detects the tilt of the second pressing member 32. A specific example of the detection unit 40 is a photo interrupter. The detection unit 40 is provided at a location where the detection unit 40 faces the shielding plate 363 of the second pressing member 32 in the Z-axis direction.

The base 4 has the dome 41. The dome 41 is a member which provides to a user a clicking feeling (moderation feeling) when the user pushes the first pressing member 31. The dome 41 is a member which can be buckled or elastically deformed. The dome 41 which can be buckled is, for example, a metal dome. The dome 41 which can be elastically deformed, is, for example, a rubber dome. The dome 41 is provided on the first surface 460*a*. The dome 41 is provided to face the pressing section 365 of the second pressing member 32 in the Z-axis direction. A boss reception part 467 having a concave surface is provided at a location symmetrical to the dome 41 about the center C3 of the through hole 463. The boss 326*c* of the second pressing member 32 is disposed in the boss reception part 467 (see FIGS. 29A and 29B).

As illustrated in FIG. 26B, the circuit block 8 is held by the base 4. The circuit block 8 includes a flexible printed wiring board 83, the detection unit 40 described above, and two rotation detection units 80.

The flexible printed wiring board 83 includes the body part 830 and the extension section 831. The body part 830 is reinforced by a reinforcing plate 85 disposed thereon (see FIG. 24). The body part 830 has a through hole. As illustrated in FIG. 26B, a boss 468 of the base 4 is inserted into the through hole, and heat caulking is performed, thereby fixing the body part 830 in the interior of the base 4.

The body part 830 includes the detection unit 40 and the two rotation detection units 80. The two rotation detection units 80 each have a structure similar to the structure of the detection unit 40. That is, each rotation detection unit 80 includes a light-emitting unit and a light-receiving unit which face each other with a slit 80*a* provided therebetween. As illustrated in FIG. 26B, two rotation detection units 81 and 82 are provided to the base 4 such that a circumference D overlaps the slit 80*a*. The circumference D is a path through which a shielding plate 57 (FIGS. 27B and 28) of the rotor 5 passes. The shielding plate 57 of the rotor 5 passes through the slit 80*a* and shields light from the light-emitting unit to the light-receiving unit, and thereby, the rotation detection unit 80 detects rotation of the rotor 5. Since the two rotation detection units 81 and 82 are provided, the rotation direction and the rotation amount of the rotor 5 can be detected. The rotation direction includes both a clockwise direction and an anticlockwise direction in an XY plane. Thus, the circuit block 8 is configured to detect the rotation amount of the rotor 5.

The extension section 831 extends from the body part 830. The extension section 831 extends through the opening 461*a* formed in the base 4 and is pulled out of the base 4. The extension section 831 is covered with a coverlay 84 for protection of wiring. The wiring is formed from the detection unit 40 and the rotation detection unit 80 to the terminal part 831*a* which is a tip end of the extension section 831. The terminal part 831*a* is reinforced by a reinforcing plate 87 disposed thereon. The length of the extension section 831 is not particularly limited.

The rotor 5 surrounds the cylindrical part 21 of the holding member 2. The rotor 5 is rotatable around the cylindrical part 21.

Figure 27A:
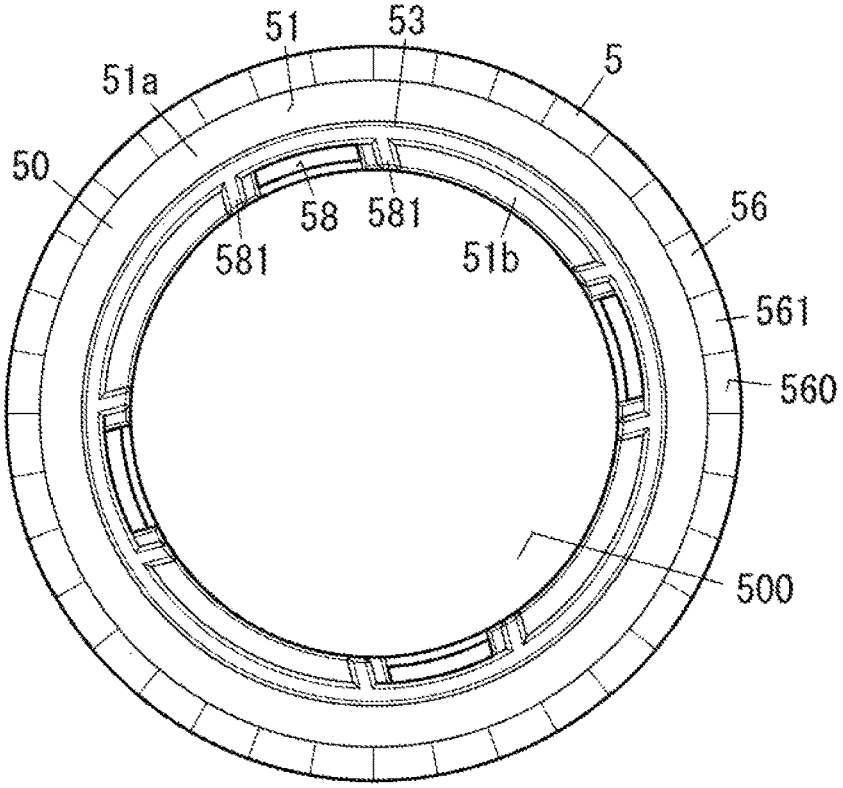
FIG. 27A is a plan view illustrating a rotor in the press-rotate-type input device of the fifth embodiment.
Figure 27B:
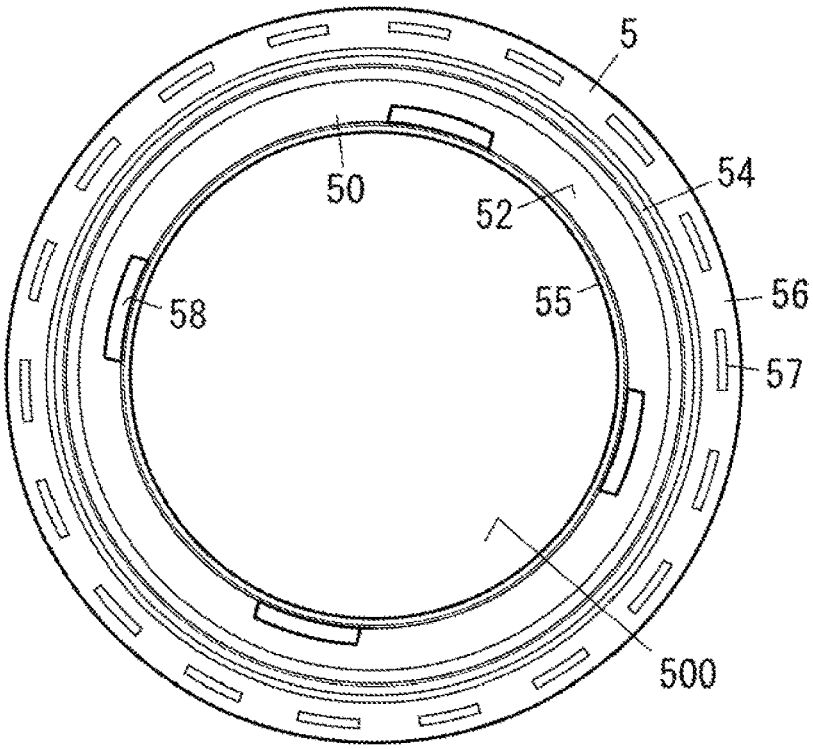
FIG. 27B is a bottom view illustrating a rotor in the press-rotate-type input device of the fifth embodiment.

The rotor 5 is, for example, a resin molded body and is electrically insulating. As illustrated in FIGS. 27A and 27B, the rotor 5 is a member having an annular shape. More specifically, the rotor 5 has a body part 50 which is annular, a cylindrical part 53, and a flange 56.

At the center of the body part 50, a through hole 500 which is circular is provided parallel to the Z-axis. The body part 50 has a first surface 51 and a second surface 52. The first surface 51 is in the positive direction of the Z-axis. The second surface 52 is in the negative direction of the Z-axis. The first surface 51 and the second surface 52 are respectively front and rear surfaces of the body part 50. The first surface 51 and the second surface 52 are annular band-like surfaces when viewed along the Z-axis direction.

The cylindrical part 53 protrudes in the positive direction of the Z-axis such that the first surface 51 of the body part 50 is divided into two parts. The cylindrical part 53 divides the first surface 51 into an outer side area 51*a* and an inner side area 51*b*. The outer side area 51*a* is an annular band-like area present on an outer side of the cylindrical part 53. The inner side area 51*b* is an annular band-like area present on an inner side of the cylindrical part 53. The outer side area 51*a* and the inner side area 51*b* are concentric. The center of the outer side area 51*a* and the center of the inner side area 51*b* correspond to the center of the through hole 500.

The body part 50 includes an outer wall 54 and an inner wall 55. The outer wall 54 protrudes from an outer peripheral edge of the body part 50 in the negative direction of the Z-axis. The inner wall 55 protrudes from an inner periphery of the body part 50 in the negative direction of the Z-axis. The through hole 500 is surrounded by the inner wall 55 and penetrates parallel to the Z-axis through the inner wall 55.

The flange 56 protrudes parallel to the XY plane from an outer peripheral surface of the outer wall 54 of the body part 50. The flange 56 has a uniform width.

As illustrated in FIGS. 24 and 27A, the flange 56 has a surface facing the spring member 60 and provided with a plurality of projections 561. The plurality of projections 561 are arranged in the circumferential direction of the flange 56 at substantially the same intervals. The plurality of projections 561 are provided over the entire circumference of the flange 56. Thus, the flange 56 has a concave-convex surface 560 repeatedly having recesses and projections in the circumferential direction.

Figure 28:
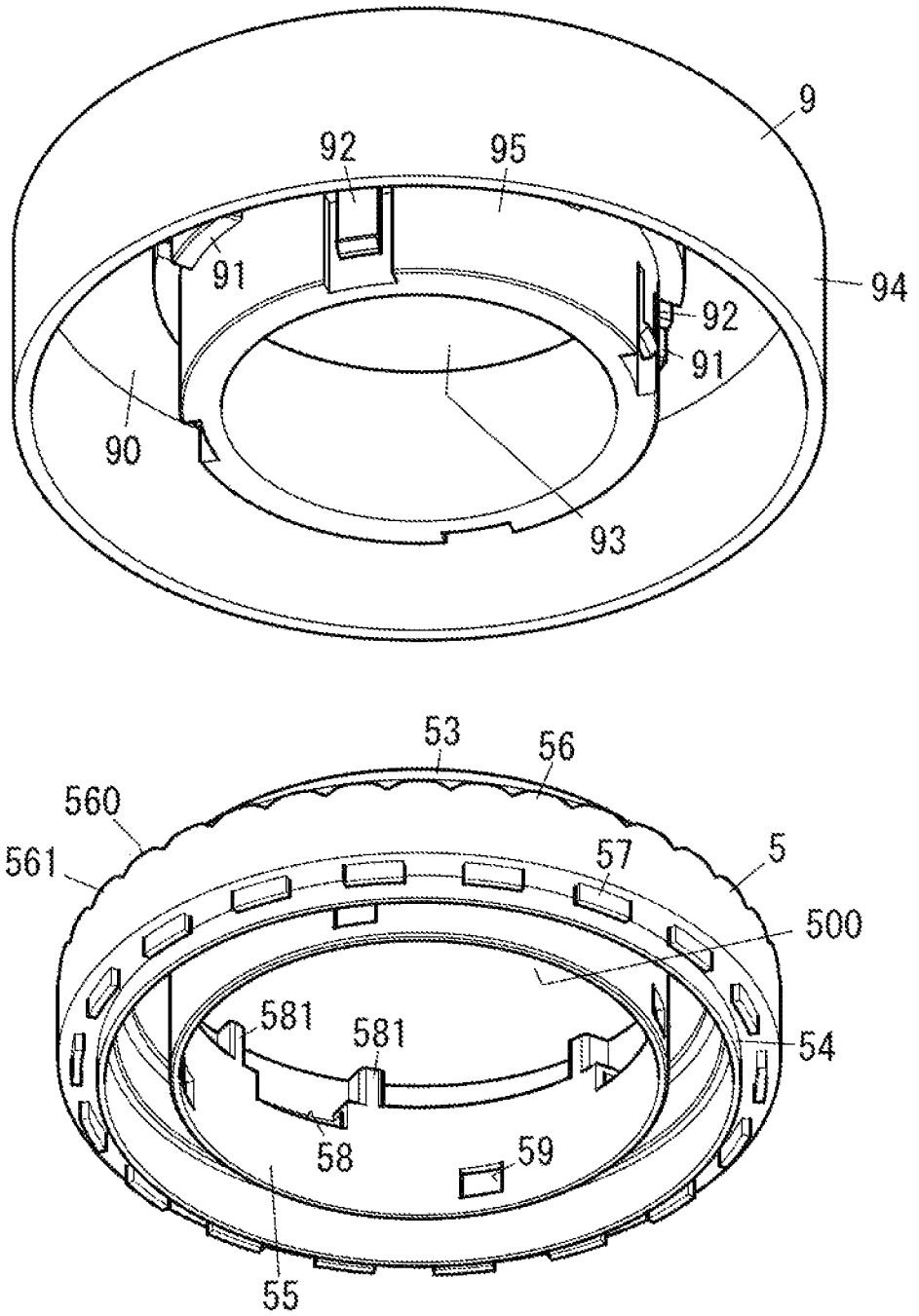
FIG. 28 is a perspective view illustrating a knob and the rotor of the press-rotate-type input device of the fifth embodiment viewed from below.

As illustrated in FIGS. 27B and 28, the flange 56 has a surface facing the base 4 and provided with a plurality of shielding plates 57. The plurality of shielding plates 57 are arranged in the circumferential direction of the flange 56 at substantially the same intervals. The plurality of shielding plates 57 are provided over the entire circumference of the flange 56.

As illustrated in FIGS. 27A and 27B, the rotor 5 has a plurality of (in the present embodiment, four) groove recesses 58. The plurality of groove recesses 58 are provided around the through hole 500 at substantially equal intervals. The groove recesses 58 extend from the inner side area 51*b* of the body part 50 to the inner wall 55. On both sides of each groove recess 58, guide projections 581 are provided. Through the groove recesses 58, the pressure receiving surface 310 of the first pressing member 31 is exposed (see FIG. 23). Projection sections 91 of the knob 9 are insertable into the groove recesses 58 (see FIG. 28).

As illustrated in FIG. 28, the rotor 5 has a plurality of (in the present embodiment, four) opening sections 59. The plurality of opening sections 59 are provided around the through hole 500 at substantially equal intervals. The opening sections 59 are provided in the inner wall 55 of the body part 50. Connection sections 92 of the knob 9 are insertable into the opening sections 59.

In the present embodiment, the press-rotate-type input device 10 includes two spring members 60 as illustrated in FIG. 24. Each spring member 60 is a member which provides to a user a clicking feeling, for example, when the user rotates the rotor 5. Each spring member 60 includes a plate spring unit 601, a clicking projection 602, and fixing parts 603.

The plate spring unit 601 has a shape conforming to the outer peripheral shape of the outer wall 54 of the rotor 5. In the present embodiment, the plate spring unit 601 has an arc-like shape. The plate spring unit 601 overlaps the concave-convex surface 560 of the flange 56 in a direction parallel to the rotation axis of the rotor 5.

The clicking projection 602 is integrated with the plate spring unit 601. The clicking projection 602 protrudes in U-shape toward the flange 56 at a central part of the plate spring unit 601. The clicking projections 602 are each insertable into and removable from a recess between each two adjacent projections 561 of the plurality of projections 561 of the concave-convex surface 560 of the flange 56.

The fixing parts 603 are located at respective ends of each plate spring unit 601. Each fixing part 603 has a pore 604 in which a joint projection is to extend. The joint projection protrudes from the bracket body 701 of the fixing bracket 7 in a thickness direction of the bracket body 701. In a state where the fixing part 603 is placed to lie over the bracket body 701 such that the joint projection extends through the pore 604 formed in the fixing part 603, a tip end of the joint projection is clamped, thereby fixing the spring member 60 to the fixing bracket 7.

The fixing bracket 7 is a bracket for attaching the rotor 5 to the base 4. The fixing bracket 7 covers the flange 56 of the rotor 5 and the spring member 60 accommodated in the base 4. The fixing bracket 7 is formed from, for example, a steel plate. The fixing bracket 7 includes the bracket body 701 which is annular, the plurality of (in the present embodiment, four) connection pieces 702, and the closing piece 703. The outer diameter of the fixing bracket 7 is substantially equal to the outer diameter of the base 4.

The bracket body 701 of the fixing bracket 7 has a through hole 700. The inner diameter of the through hole 700 is substantially equal to the outer diameter of the cylindrical part 53 of the rotor 5.

The plurality of connection pieces 702 are parts to be fitted in the grooves 461*b* formed in the base 4. The closing piece 703 is a part closing the opening 461*a* formed in the base 4. The plurality of connection pieces 702 and the closing piece 703 protrude from an outer peripheral edge of the bracket body 701. The plurality of connection pieces 702 and the closing piece 703 are apart from each other in the circumferential direction of the bracket body 701.

The knob 9 is, for example, a resin molded body and is electrically insulating. As illustrated in FIG. 28, the knob 9 is an annular member. More specifically, the knob 9 has a body part 90 which is annular, an outer wall 94, and an inner wall 95. The outer wall 94 protrudes from an outer peripheral edge of the body part 90 toward the rotor 5. The inner wall 95 protrudes from an inner peripheral edge of the body part 90 toward the rotor 5. The knob has a through hole 93 which is circular. The through hole 93 is surrounded by the inner wall 95.

The knob 9 has the plurality of (in the present embodiment, four) projection sections 91. The plurality of projection sections 91 are provided at substantially equal intervals on a surface of the inner wall 95 facing the outer wall 94. Each projection section 91 is insertable through the groove recesses 58 while guided by the pair of guide projections 581 of the rotor 5 to push the pressure receiving surface 310 of the first pressing member 31.

The knob 9 has the plurality of (in the present embodiment, four) connection sections 92. The plurality of connection sections 92 are provided at substantially equal intervals on the surface of the inner wall 95 facing the outer wall 94. Each connection section 92 has a tip end provided with a claw protruding toward the outer wall 94. When the cylindrical inner wall 95 is inserted into the through hole 500 formed in the rotor 5, the connection sections 92 of the knob 9 are caught in the opening sections 59 of the rotor 5, and connection is thus possible. However, in a direction (in the Z-axis direction) in which the knob 9 is pushed, the claw of the connection section 92 is movable in the opening section 59.

5.3 Assembly

Next, an assembling method of the press-rotate-type input device 10 will be described.

First of all, the circuit block 8 is attached to the base 4. In addition, the second pressing member 32 is placed in the interior of the base 4, the first pressing member 31 is put on the second pressing member 32 and is covered with the holding member 2. The bosses 213*b* of the holding member 2 are inserted into the through holes 469 formed in the base 4, thereby fixing the holding member 2 to the base 4 by heat caulking or the like. In this way, the press-type input device 1 is assembled at first.

Then, the rotor 5 is attached to the press-type input device 1. Specifically, the cylindrical part 21 of the holding member 2 is inserted into the through hole 500 formed in the rotor 5. The flange 56 of the rotor 5 is disposed in the base 4. The shielding plate 57 of the flange 56 is disposed within a space surrounded by the flange 56 and the base 4.

Next, the fixing bracket 7 to which the spring members 60 are attached is attached to and fixed to the base 4. At this time, the closing piece 703 of the fixing bracket 7 closes the opening 461*a* of the base 4. The connection pieces 702 of the fixing bracket 7 are fit in the grooves 461*b* formed in the base 4, and the tip ends of the connection pieces 702 are bent into an L-shape and are clamped, thereby fixing the fixing bracket 7 to the base 4.

As a result, the press-rotate-type input device 10 shown in FIG. 23 is assembled. The knob 9 may be further attached as necessary. That is, the connection sections 92 of the knob 9 are inserted into the opening sections 59 of the rotor 5.

5.4 Operation

Next, operation of the press-rotate-type input device 10 will be described. Note that operation described below is an example in which the knob 9 is attached.

First, a push operation will be described. When a user pushes the knob 9, the projection sections 91 of the knob 9 are inserted into the groove recesses 58 formed in the rotor 5, thereby pushing the pressure receiving surface 310 of the first pressing member 31. This pushes the second pressing member 32, and the shielding plate 363 thereof is inserted into the slit 40*a* formed in the detection unit 40, and thereby, the detection unit 40 detects the tilt of the second pressing member 32. The dome 41 deforms substantially at the same time, which provides a clicking feeling to a user.

Now, the push operation described above will be supplementarily described with reference to FIGS. 29A and 29B. Note that the knob 9 is omitted in FIGS. 29A and 29B.

Figure 29A:
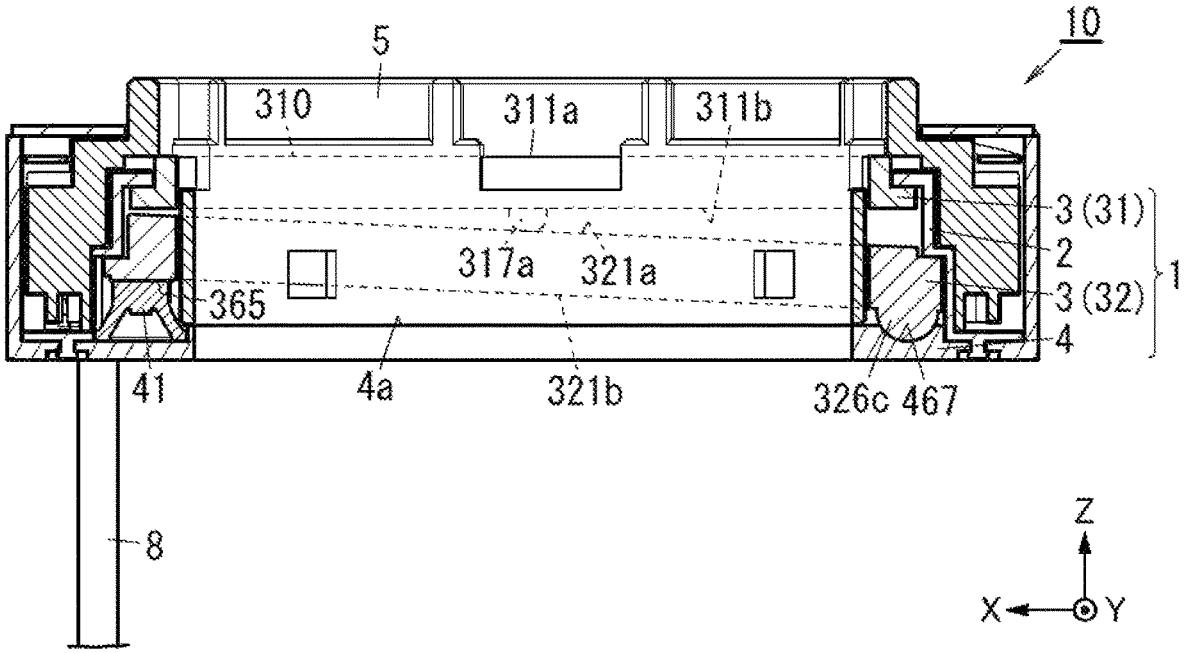
FIG. 29A and FIG. 29B are views (schematic sectional views) each illustrating a schema of operation of the press-rotate-type input device of the fifth embodiment.

FIG. 29A shows a state where the pressure receiving surface 310 of the first pressing member 31 is not pushed. In this state, the first pressing member 31 is parallel to the XY plane. More specifically, the first surface 311*a* and the second surface 311*b* of the first pressing member 31 are parallel to the XY plane. In addition, the second pressing member 32 tilts to the XY plane. More specifically, the second pressing member 32 tilts such that the tilt is positive on an XZ plane. Moreover, the first surface 4*a* of the base 4 is parallel to the XY plane. Thus, when viewed along the Y-axis direction, a substantially wedge-like gap is present between the second surface 311*b* of the first pressing member 31 and the first surface 321*a* of the second pressing member 32. Similarly, a substantially wedge-like gap is present between the second surface 321*b* of the second pressing member 32 and the first surface 4*a* of the base 4.

Figure 29B:
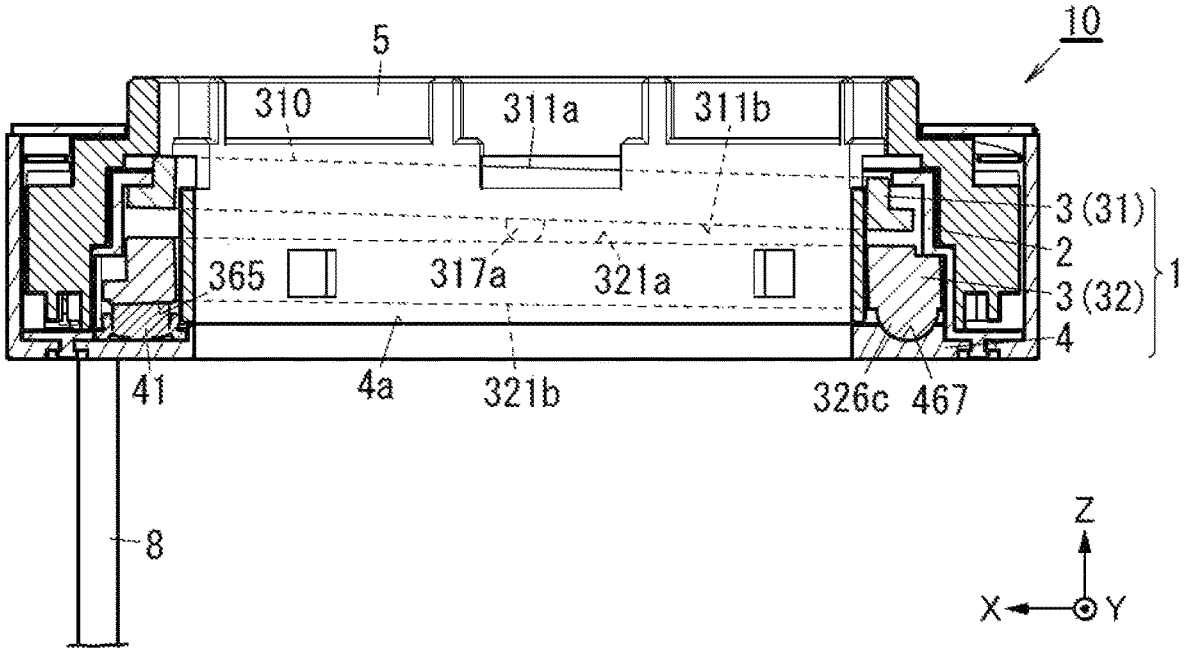

On the other hand, FIG. 29B shows a state where the pressure receiving surface 310 of the first pressing member 31 is pushed. In FIG. 29B, the first pressing member 31 tilts, but the first pressing member 31 does not have to tilt. That is, the first pressing member 31 may move in the negative direction of the Z-axis while being maintained parallel to the XY plane. Moreover, the second pressing member 32 is pushed by the bosses 317*a* and 317*b* provided on the second surface 311*b* of the first pressing member 31 and tilts with the boss 326*c* serving as a supporting point, and thereby, the second pressing member 32 pushes the dome 41. Although not shown in FIG. 29B, the shielding plate 363 of the second pressing member 32 is inserted into the slit 40*a* formed in the detection unit 40 substantially at the same time as the dome 41 is pushed. Also in this state, the gap remains between the second surface 321*b* of the second pressing member 32 and the first surface 4*a* of the base 4.

No matter where the pressure receiving surface 310 of the first pressing member 31 is pushed, the second pressing member 32 operates substantially in a similar manner to the operation described above. That is, no matter where on the pressure receiving surface 310 pushing force is exerted, the pushing force is detectable by the detection unit 40, and the dome 41 is pushed substantially at the same time, which provides a clicking feeling to the user.

Next, a rotation operation will be described. When a user rotates the knob 9, the rotor 5 rotates, and the shielding plate 57 of the rotor 5 moves on the circumference D in the base 4 (see FIG. 26B). Thus, the shielding plate 57 passes through the slit 80*a* formed in the rotation detection unit 80, based on which the rotation amount of the rotor 5 is detected. When the rotor 5 rotates, the clicking projections 602 of the spring members 60 provide a clicking feeling to the user.

In the present embodiment, the pressing member 3 and the rotor 5 are separate members and are configured to operate independently of each other. That is, even when the pressing member 3 is pushed, the rotor 5 is not pushed. In addition, even when the rotor 5 rotates, the pressing member 3 does not rotate.

When the rotor 5 rotates, the pressure receiving surface 310 of the first pressing member 31 exposed through the groove recesses 58 formed in the rotor 5 changes. Since the press-rotate-type input device 10 according to the present embodiment includes the press-type input device 1, pushing force is detectable by the detection unit 40 no matter where on the pressure receiving surface 310 the pushing force is exerted.

6. Summary

As can be seen from the embodiments and the like described above, the present disclosure includes the following aspects. In the following description, reference signs in parentheses are added only to clarify the correspondence relationship to the embodiments.

A press-type input device (1) according to a first aspect of the present disclosure includes a first pressing member (31), a second pressing member (32), a base (4), and a holding member (2). The first pressing member (31) has a pressure receiving surface (310) and a first axis (S1) and is tiltable around the first axis (S1) by the pressure receiving surface (310) being pushed. The second pressing member (32) has a second axis (S2) and is tiltable around the second axis (S2) by being pushed due to a tilt of the first pressing member (31). The base (4) includes at least one detection unit (40) configured to detect a tilt of the second pressing member (32). The holding member (2) is configured to hold, together with the base (4), the first pressing member (31) and the second pressing member (32). A location of at least one of the first axis (S1) or the second axis (S2) is variable in accordance with a pushed location of the pressure receiving surface (310). The second axis (S2) and the at least one detection unit (40) do not overlap each other when viewed in a direction vertical to the pressure receiving surface (310).

With this aspect, pushing force is detectable by the at least one detection unit (40) no matter where on the pressure receiving surface (310) the pushing force is exerted.

In a press-type input device (1) of a second aspect referring the first aspect, along the direction vertical to the pressure receiving surface (310), the second pressing member (32) and the base (4) are in contact with each other at two contact points one of which is the at least one detection unit (40). The first pressing member (31) and the second pressing member (32) are in contact with each other at two contact points. A line segment connecting the two contact points of the first pressing member (31) and the second pressing member (32) and a line segment connecting the two contact points of the second pressing member (32) and the base (4) intersect each other.

This aspect stabilizes a holding state of the first pressing member (31) and the second pressing member (32).

In a press-type input device (1) of a third aspect referring the second aspect, the line segment connecting the two contact points of the second pressing member (32) and the base (4) is a bisector of the line segment connecting the two contact points of the first pressing member (31) and the second pressing member (32).

This aspect further stabilizes the holding state of the first pressing member (31) and the second pressing member (32).

In a press-type input device (1) of a fourth aspect referring the second or third aspect, the two contact points of the first pressing member (31) and the second pressing member (32) and the two contact points of the second pressing member (32) and the base (4) are located at apexes of a substantially square shape.

With this aspect, the pushing force exerted on the pressure receiving surface (310) is detectable by the at least one detection unit (40) without significantly changing the pushing force depending on a place on the pressure receiving surface (310).

In a press-type input device (1) of a fifth aspect referring any one of the first to fourth aspects, along the direction vertical to the pressure receiving surface (310), the first pressing member (31) is in contact with the holding member (2) at a total of four contact points.

This aspect stabilizes a holding state of the first pressing member (31) and the second pressing member (32).

In a press-type input device (1) of a sixth aspect referring the fifth aspect, when viewed in the vertical direction with respect to the pressure receiving surface (310), the four contact points of the first pressing member (31) and the holding member (2) overlap the two contact points of the first pressing member (31) and the second pressing member (32) and the two contact points of the second pressing member (32) and the base (4).

This aspect further stabilizes the holding state of the first pressing member (31) and the second pressing member (32).

In a press-type input device (1) of a seventh aspect referring any one of the second to fourth aspects, along the direction vertical to the pressure receiving surface (310), the first pressing member (31), which has a circular or elliptical shape in a form of a ring, is in contact with the holding member (2). A center of the circular or elliptical shape is a midpoint of the two contact points of the first pressing member (31) and the second pressing member (32).

This aspect further stabilizes the holding state of the first pressing member (31) and the second pressing member (32).

In a press-type input device (1) of an eighth aspect referring the seventh aspect, when viewed in the direction vertical to the pressure receiving surface (310), a contact surface of the first pressing member (31) and the holding member (2) overlap the two contact points of the first pressing member (31) and the second pressing member (32) and the two contact points of the second pressing member (32) and the base (4).

This aspect further stabilizes the holding state of the first pressing member (31) and the second pressing member (32).

In a press-type input device (1) of a ninth aspect referring any one of the second to fourth aspects, along the direction vertical to the pressure receiving surface (310), the first pressing member (31), which has a substantially rectangular shape in a form of a ring, is in contact with the holding member (2). A center of the substantially rectangular shape is a midpoint of the two contact points of the first pressing member (31) and the second pressing member (32).

This aspect stabilizes a holding state of the first pressing member (31) and the second pressing member (32).

In a press-type input device (1) of a tenth aspect referring the ninth aspect, along the direction vertical to the pressure receiving surface (310), two sides of the substantially rectangular shape which face each other are vertical to a line segment connecting the two contact points of the first pressing member (31) and the second pressing member (32). Remaining two sides of the substantially rectangular shape which face each other are vertical to a line segment connecting the two contact points of the second pressing member (32) and the base (4).

This aspect stabilizes a holding state of the first pressing member (31) and the second pressing member (32).

In a press-type input device (1) of an eleventh aspect referring the tenth aspect, when viewed in the direction vertical to the pressure receiving surface (310), a contact surface of the first pressing member (31) and the holding member (2) overlap the two contact points of the first pressing member (31) and the second pressing member (32) and the two contact points of the second pressing member (32) and the base (4).

This aspect stabilizes a holding state of the first pressing member (31) and the second pressing member (32).

In a press-type input device (1) of a twelfth aspect referring the first aspect, along the direction vertical to the pressure receiving surface (310), the second pressing member (32) and the base (4) are in contact with each other at two contact points one of which is the at least one detection unit (40). The first pressing member (31) and the second pressing member (32) are in contact with each other at one contact point. The one contact point of the first pressing member (31) and the second pressing member (32) is located on a line segment connecting the two contact points of the second pressing member (32) and the base (4).

This aspect stabilizes a holding state of the first pressing member (31) and the second pressing member (32).

In a press-type input device (1) of a thirteenth aspect referring the twelfth aspect, along the direction vertical to the pressure receiving surface (310), the first pressing member (31), which has a circular, elliptical, or rectangular shape in a form of a ring, is in contact with the holding member (2). A center of the circular, elliptical, or rectangular shape is the one contact point of the first pressing member (31) and the second pressing member (32).

This aspect stabilizes a holding state of the first pressing member (31) and the second pressing member (32).

In a press-type input device (1) of a fourteenth aspect referring any one of the first to thirteenth aspects, the first pressing member (31) and the second pressing member (32) each have an annular shape.

With this aspect, the interior of a through hole (313) formed in the first pressing member (31) and the interior of a through hole (323) formed in the second pressing member (32) can be used for other applications (e.g., display).

In a press-type input device (1) of a fifteenth aspect referring any one of the first to fourteenth aspects, the at least one detection unit (40) includes only one detection unit.

With this configuration, multiple clicks such as double clicks can be suppressed.

The press-rotate-type input device (10) of a sixteenth aspect includes the press-type input device (1) of any one of the first to fifteenth aspects, a rotor (5), and a circuit block (8). The press-type input device (1) has a cylindrical part (21). The rotor (5) surrounds the cylindrical part (21) and is rotatable around the cylindrical part (21). The circuit block (8) is held by the base (4) of the press-type input device (1) and is configured to detect a rotation amount of the rotor (5).

With this aspect, both a push operation input and a rotation operation input are possible.

REFERENCE SIGNS LIST

1 Press-Type Input Device
10 Press-Rotate-Type Input Device
2 Holding Member
20 Opening
21 Cylindrical Part
31 First Pressing Member
310 Pressure Receiving Surface
32 Second Pressing Member
4 Base
40 Detection Unit
5 Rotor
8 Circuit Block
S1 First Axis
S2 Second Axis

The invention claimed is:

1. An input device configured to receive a push input operation, comprising:

a first pressing member having a pressure receiving surface and a first axis and being configured to be tiltable around the first axis by the pressure receiving surface being pushed;

a second pressing member having a second axis and being configured to be tiltable around the second axis by being pushed due to a tilt of the first pressing member;

a base including at least one detection unit configured to detect a tilt of the second pressing member; and a holding member configured to hold, together with the base, the first pressing member and the second pressing member, wherein:

a location of at least one of the first axis or the second axis is variable in accordance with a pushed location of the pressure receiving surface, the second axis and the at least one detection unit do not overlap each other when viewed in a direction vertical to the pressure receiving surface, along the direction vertical to the pressure receiving surface, the second pressing member and the base are in contact with each other at two contact points including the at least one detection unit, the first pressing member and the second pressing member are in contact with each other at two contact points, and a line segment connecting the two contact points of the first pressing member and the second pressing member and a line segment connecting the two contact points of the second pressing member and the base intersect each other.

2. The input device of claim 1, wherein the line segment connecting the two contact points of the second pressing member and the base is a bisector of the line segment connecting the two contact points of the first pressing member and the second pressing member.

3. The input device of claim 1, wherein the two contact points of the first pressing member and the second pressing member and the two contact points of the second pressing member and the base are located at apexes of a substantially square shape.

4. The input device of claim 1, wherein along the direction vertical to the pressure receiving surface, the first pressing member is in contact with the holding member at a total of four contact points.

5. The input device of claim 4, wherein when viewed in the vertical direction with respect to the pressure receiving surface, the four contact points of the first pressing member and the holding member overlap the two contact points of the first pressing member and the second pressing member and the two contact points of the second pressing member and the base.

6. The input device of claim 1, wherein:

along the direction vertical to the pressure receiving surface, the first pressing member, which has a circular or elliptical shape in a form of a ring, is in contact with the holding member, and a center of the circular or elliptical shape is a midpoint of the two contact points of the first pressing member and the second pressing member.

7. The input device of claim 6, wherein when viewed in the direction vertical to the pressure receiving surface, a contact surface of the first pressing member and the holding member overlaps the two contact points of the first pressing member and the second pressing member and the two contact points of the second pressing member and the base.

8. The input device of claim 1, wherein:

along the direction vertical to the pressure receiving surface, the first pressing member, which has a substantially rectangular shape in a form of a ring, is in contact with the holding member, and a center of the substantially rectangular shape is a midpoint of the two contact points of the first pressing member and the second pressing member.

9. The input device of claim 8, wherein:

along the direction vertical to the pressure receiving surface, two sides of the substantially rectangular shape which face each other are vertical to a line segment connecting the two contact points of the first pressing member and the second pressing member, and remaining two sides of the substantially rectangular shape which face each other are vertical to a line segment connecting the two contact points of the second pressing member and the base.

10. The input device of claim 9, wherein when viewed in the direction vertical to the pressure receiving surface, a contact surface of the first pressing member and the holding member overlaps the two contact points of the first pressing member and the second pressing member and the two contact points of the second pressing member and the base.

11. The input device of claim 1, wherein:

along the direction vertical to the pressure receiving surface, the second pressing member and the base are in contact with each other at two contact points including the at least one detection unit, the first pressing member and the second pressing member are in contact with each other at one contact point, and the one contact point of the first pressing member and the second pressing member is located on a line segment connecting the two contact points of the second pressing member and the base.

12. The input device of claim 11, wherein:

along the direction vertical to the pressure receiving surface, the first pressing member, which has a circular, elliptical, or rectangular shape in a form of a ring, is in contact with the holding member, and a center of the circular, elliptical, or rectangular shape is the one contact point of the first pressing member and the second pressing member.

13. The input device of claim 1, wherein the first pressing member and the second pressing member each have an annular shape or an annular shape surrounding a transparent member.

14. The input device of claim 1, wherein the at least one detection unit includes only one detection unit.

15. An input device configured to receive a push input operation and a rotation input operation, comprising:

a first pressing member having a pressure receiving surface and a first axis and being configured to be tiltable around the first axis by the pressure receiving surface being pushed;

a second pressing member having a second axis and being configured to be tiltable around the second axis by being pushed due to a tilt of the first pressing member;

a base including at least one detection unit configured to detect a tilt of the second pressing member;

a holding member configured to hold, together with the base, the first pressing member and the second pressing member;

a rotor;

a circuit block; and a cylindrical part, wherein:

a location of at least one of the first axis or the second axis is variable in accordance with a pushed location of the pressure receiving surface, the second axis and the at least one detection unit do not overlap each other when viewed in a direction vertical to the pressure receiving surface, the rotor surrounds the cylindrical part and is rotatable around the cylindrical part, and the circuit block is held by the base and is configured to detect a rotation amount of the rotor.

16. An input device configured to receive a push input operation, comprising:

a first pressing member having a pressure receiving surface and a first axis and being configured to be tiltable around the first axis by the pressure receiving surface being pushed;

a second pressing member having a second axis and being configured to be tiltable around the second axis by being pushed due to a tilt of the first pressing member;

a base including at least one detection unit configured to detect a tilt of the second pressing member; and a holding member configured to hold, together with the base, the first pressing member and the second pressing member, wherein:

a location of at least one of the first axis or the second axis is variable in accordance with a pushed location of the pressure receiving surface, the second axis and the at least one detection unit do not overlap each other when viewed in a direction vertical to the pressure receiving surface, and along the direction vertical to the pressure receiving surface, the first pressing member is in contact with the holding member at a total of four contact points.

* * * * *